United States Patent [19]

Nishimura et al.

[11] Patent Number: 4,898,138

[45] Date of Patent: Feb. 6, 1990

[54] ENGINE CONTROL APPARATUS

[75] Inventors: Eiji Nishimura; Kazutoshi Nobumoto, both of Hiroshima; Toshihiro Matsuoka; Toshiaki Tsuyama, both of Higashihiroshima; Kaoru Sotoyama, Hatsukaichi, all of Japan

[73] Assignee: Mazda Motor Corporation, Hiroshima, Japan

[21] Appl. No.: 261,971

[22] Filed: Oct. 24, 1988

[30] Foreign Application Priority Data

Oct. 26, 1987 [JP] Japan ..... 62-268307

[51] Int. Cl.[4] ..... F02D 11/10

[52] U.S. Cl. ..... 123/399

[58] Field of Search ..... 123/399, 361, 340, 489, 123/352

[56] References Cited

U.S. PATENT DOCUMENTS 4,765,296 8/1988 Ishikawa et al. ..... 123/399
4,771,752 9/1988 Nishimura et al. ..... 123/489
4,779,592 10/1988 Takauchi et al. ..... 123/399
4,781,162 11/1988 Ishikawa et al. ..... 123/399
4,787,353 11/1988 Ishikawa et al. ..... 123/399
4,791,902 12/1988 Ishikawa et al. ..... 123/399

*Primary Examiner*—Raymond A. Nelli
*Attorney, Agent, or Firm*—Lynn L. Augspurger

[57] ABSTRACT

An engine control apparatus includes an operation amount detection section for detecting an operation amount of an acceleration pedal, a throttle valve for adjusting an engine output, an arithmetic section for receiving the output from the operation amount detection section and calculating a control amount corresponding to the output operation amount of the acceleration pedal in accordance with a predetermined characteristic, the control amount being one for controlling the throttle valve, a motor for receiving the output from the arithmetic section and driving the throttle valve in accordance with the control amount calculated by the arithmetic section, a return detection section for detecting a return state of the acceleration pedal, and a control section for, when the return detection section detects the return state of the acceleration pedal, controlling the arithmetic section to output the control amount in accordance with a characteristic with which the engine output is decreased below that according to the predetermined characteristic.

14 Claims, 27 Drawing Sheets

$\dot{\alpha} \geqq \dot{\alpha}_0$

| MODE SWITCH (M) \ GEAR POSITION (GP) | 2 | 3 | 4 |
|---|---|---|---|
| ECONOMY | 1 | 1 | 1 |
| NORMAL | 0.04 | 0.06 | 0.08 |
| POWER | 0.02 | 0.04 | 0.06 |

(a)

$\dot{\alpha} \leqq \dot{\alpha}_0$

| MODE SWITCH (M) \ GEAR POSITION (GP) | 2 | 3 | 4 |
|---|---|---|---|
| ECONOMY | 1 | 1 | 1 |
| NORMAL | 0.06 | 0.08 | 0.1 |
| POWER | 0.04 | 0.06 | 0.08 |

(b)

FIG. 9E

ENGINE CONTROL APPARATUS

BACKGROUND OF THE INVENTION

The present invention relates to an engine control apparatus and, more particularly, to an improvement of a response of an engine output adjusting means such as a throttle valve with respect to an operation of the accelerator.

Factors for adjusting an output of a vehicle engine include a fuel supply amount, an air-fuel ratio, and the like. A dominant factor for determining these adjustment factors is, e.g., an opening of a throttle valve in a gasoline engine. In a typical gasoline engine, the throttle valve is mechanically engaged with an acceleration pedal, and hence, the throttle opening is determined by a depression amount of the acceleration pedal. However, adjustment of the throttle opening by the mechanical engagement cannot allow adjustment of an engine output in correspondence with a change in operation state since the depression amount of the acceleration pedal has a direct correspondence with the throttle opening.

Along with the advance of electronics, an electronically controlled throttle controller has become popular. In this controller, the acceleration pedal is regarded as an input source of vehicle movement request information from a driver (operator), and the operation request of the driver is judged by the vehicle side on the basis of the depression amount of the acceleration pedal, so that an optimal throttle opening is determined considering the request and the output characteristics of the engine. The following conventional electronically controlled throttle controllers are known. As a technique associated with an improvement of reliability of a throttle controller, Japanese Patent Laid-Open (Kokai) No. 59-122742 is known. As a technique associated with an improvement of characteristics of a throttle opening with respect to a depression amount of an acceleration pedal, Japanese Patent Laid-Open (Kokai) No. 61-171846 is known.

Meanwhile, along with diversification of requrements on vehicles and the advance of electronics, an engine comprising of a supercharger such as a turbo charger, a vehicle with an AT (automatic transmission system) such as an electronically controlled automatic transmission system (to be abbreviated as an EAT hereinafter), a vehicle capable of setting a variety of operation modes such as power, normal, and economy modes, a vehicle comprising of an automatic drive function, and the like have been developed and are commercially available.

In an operation of the acceleration pedal, a driver depresses an acceleration pedal to accelerate a vehicle. Therefore, if the movement of the vehicle during acceleration is slightly greater from what the driver intended, the driver does not feel unease. However, when the driver releases the acceleration pedal to decelerate the vehicle, if the movement of the vehicle is delayed, that is, if the vehicle is not quickly decelerated, the driver feels anxiety. In particular, this tendency is conspicuous when the vehicle is decelerated from a high-load state during a low engine speed operation since a decrease in effective sectional area of an air intake path with respect to a decrease in throttle opening is very small.

SUMMARY OF THE INVENTION

It is therefore an object of the present invention to provide an engine control apparatus which can eliminate the conventional drawbacks, and can improve a deceleration response, thereby enhancing travel stability.

In order to achieve the above object, a control apparatus of the present invention comprises: operation amount detection means for detecting an operation amount of an accelerator; engine output adjusting means for adjusting an engine output; arithmetic means for receiving the output from the operation amount detection means and calculating a control amount corresponding to the output operation amount of the accelerator in accordance with a predetermined characteristic, the control amount being one for controlling the engine output adjusting means; drive means for receiving the output from the arithmetic means and driving the engine output adjusting means in accordance with the control amount calculated by the arithmetic means; return detection means for detecting a return state of the accelerator; and control means for, when the return detection means detects the return state of the accelerator, controlling the arithmetic means to output the control amount in accordance with a characteristic with which the engine output is decreased below that according to the predetermined characteristic.

With this apparatus, increase and decrease states of the operation amount of the accelerator are detected During return of the accelerator, the engine output adjusting means is controlled to output a drive amount so that the engine output is decreased as compared to an increased state of the operation amount of the accelerator. As a result, deceleration response can be improved, and travel stability can be enhanced.

According to an aspect of the present invention, the adjusting means is a throttle valve arranged along an intake path of the engine, and the drive means is a motor for driving the throttle valve.

According to an aspect of the present invention, the control means is connected to the operation amount detection means, and the engine output decreasing characteristic of the control means decreases the engine output below that obtained with the predetermined characteristic in the arithmetic means with a control amount corresponding to an identical operation amount of the accelerator. With this arrangement, the characteristic in the arithmetic means is corrected so that the engine output is decreased with respect to the identical operation amount of the accelerator.

According to an aspect of the present invention, the control means is connected to the operation amount detection means, and the engine output decreasing characteristic of the control means decreases the engine output below that obtained with the predetermined characteristic in the arithmetic means with a control amount corresponding to an identical change amount of the operation amount of the accelerator. With this arrangement, the characteristic in the arithmetic means is corrected so that the engine output is decreased with respect to the identical change amount of the operation amount of the accelerator.

According to an aspect of the present invention, the return detection means detects the return state of the accelerator when a change in operation amount in the return direction of the accelerator exceeds a predetermined value.

According to an aspect of the present invention, the control apparatus further comprises means for detecting whether or not the engine output is coupled to an external drive system. The control means includes means, connected to the detecting means, for, when the detecting means detects that the engine output is not coupled to the external drive system, stopping a control operation of the drive means based on a second control amount even if the return detection means detects the return state of the accelerator. This is because when the engine output is not transmitted to the external drive system, control of the drive means based on the second control amount is unnecessary.

In order to achieve the above object, a control apparatus of the present invention comprises: operation amount detection means for detecting an operation amount of an accelerator; engine output adjusting means for adjusting an engine output; first arithmetic means for receiving the output from the operation amount detection means and calculating a first control amount corresponding to the output operation amount of the accelerator in accordance with a first characteristic, the first control amount being one for controlling the engine output adjusting means; second arithmetic means for receiving the output from the operation amount detection means and calculating a second control amount corresponding to the output operation amount of the accelerator in accordance with a second characteristic, the second control amount being one for controlling the engine output adjusting means, and the second characteristic causing an output to decrease below that obtained with the first characteristic; drive means for receiving the outputs from the first and second arithmetic means and driving the adjusting means; return detection means for detecting a return state of the accelerator; and control means for, when the return detection means does not detect the return state of the accelerator, controlling the drive means based on the first control amount and for, when the return detection means detects the return state of the accelerator, controlling the drive means based on the second control amount.

According to an aspect of the present invention, the adjusting means is a throttle valve arranged along an intake path of the engine.

According to an aspect of the present invention, the first arithmetic means stores the first control amount according to the first characteristic in the form of a map, and the second arithmetic means stores the second control amount according to the second characteristic in the form of a map. Control based on the map allows easy and high-speed operation.

According to an aspect of the present invention, the first arithmetic means comprises means for detecting an acceleration based on a change in operation amount of the accelerator, and means for receiving the output from the acceleration detection means and correcting the first characteristic to increase the engine output. With this arrangement, the engine output is controlled to increase during acceleration, and is positively controlled to decrease during deceleration, so that response with respect to an operation of the accelerator can be improved.

According to an aspect of the present invention, the first characteristic of the first arithmetic means has a relatively steep first slope with respect to an increase in operation amount while the operation amount of the accelerator is small, and has a relatively moderate second slope with respect to an increase in operation amount when the operation amount of the accelerator exceeds a predetermined value. The second characteristic of the second arithmetic means has a slope for decreasing the engine output more below that obtained with the second slope with respect to a decrease in operation amount of the accelerator when the operation amount of the accelerator exceeds the predetermined value. Engine output response with respect to the operation of the accelerator can be improved in an operation range of a middle engine speed or higher which positively requires engine response with respect to the acceleration/deceleration operation of the accelerator.

According to an aspect of the present invention, the control apparatus further includes means for detecting a transmission mode in external transmission means. The first arithmetic means and the control means are connected to the transmission mode detection means. The first arithmetic means has map means for storing the first control amount according to the first characteristic in the form of a map. The map means has a plurality of maps representing different characteristics in accordance with the transmission modes. The control means includes means for, when the transmission mode detection means detects a transmission mode corresponding to the highest efficiency, stopping an operation of controlling the drive means based on the second control amount even if the return detection means detects the return state of the accelerator. Response with respect to the operation of the accelerator is varied in accordance with the transmission mode. In this case, fine response control is achieved.

According to an aspect of the present invention, the control means includes acceleration detection means, connected to the operation amount detection means, for detecting that an increase in operation amount of the accelerator exceeds a predetermined value, and resuming means for, upon reception of the output from the acceleration detection means while the control means controls the drive means based on the second control amount, resuming control of the drive means based on the first control amount.

According to an aspect of the present invention, the control apparatus further comprises means for detecting whether or not the engine output is coupled to an external drive system. The control means includes means, connected to the detecting means, for, when the detecting means detects that the engine output is not coupled to the external drive system, stopping a control operation of the drive means based on the second control amount if the return detection means detects the return state of the accelerator. This is because when the engine output is not transmitted to the external drive system, control of the drive means based on the second control amount is unnecessary.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

FIG. 9E is table showing characteristic values of coefficient according to the modifications;

PREFERRED EMBODIMENT OF THE INVENTION

An embodiment in which the present invention is applied to electronic throttle control in a gasoline engine comprising a turbo charger and an EAT function will be described hereinafter in detail with reference to the accompanying drawings.

The EAT of this embodiment has a "D" (drive) range, an "N" (neutral) range, a "P" (park) range, an "R" (reverse) range, and the like. As will be described later, gear positions (GP) are set in correspondence with 1st to fourth (overdrive) speeds. An operation mode includes three modes, i.e., a "power" mode, a "normal" mode, and an "economy" mode in the "D" range. For these modes, corresponding transmission patterns are prepared. As will be described later, a driver can select one of these operation modes by a switch equipped in the vehicle according to his favor. Comparing speeds (transmission points) when a gear is shifted in these operation modes, the transmission points are shifted toward lower speeds in the order of the modes described above. More specifically, paying attention to a given engine speed, the transmission ratio is relatively reduced in this order.

SUMMARY OF THE EMBODIMENT

Figure 1A:
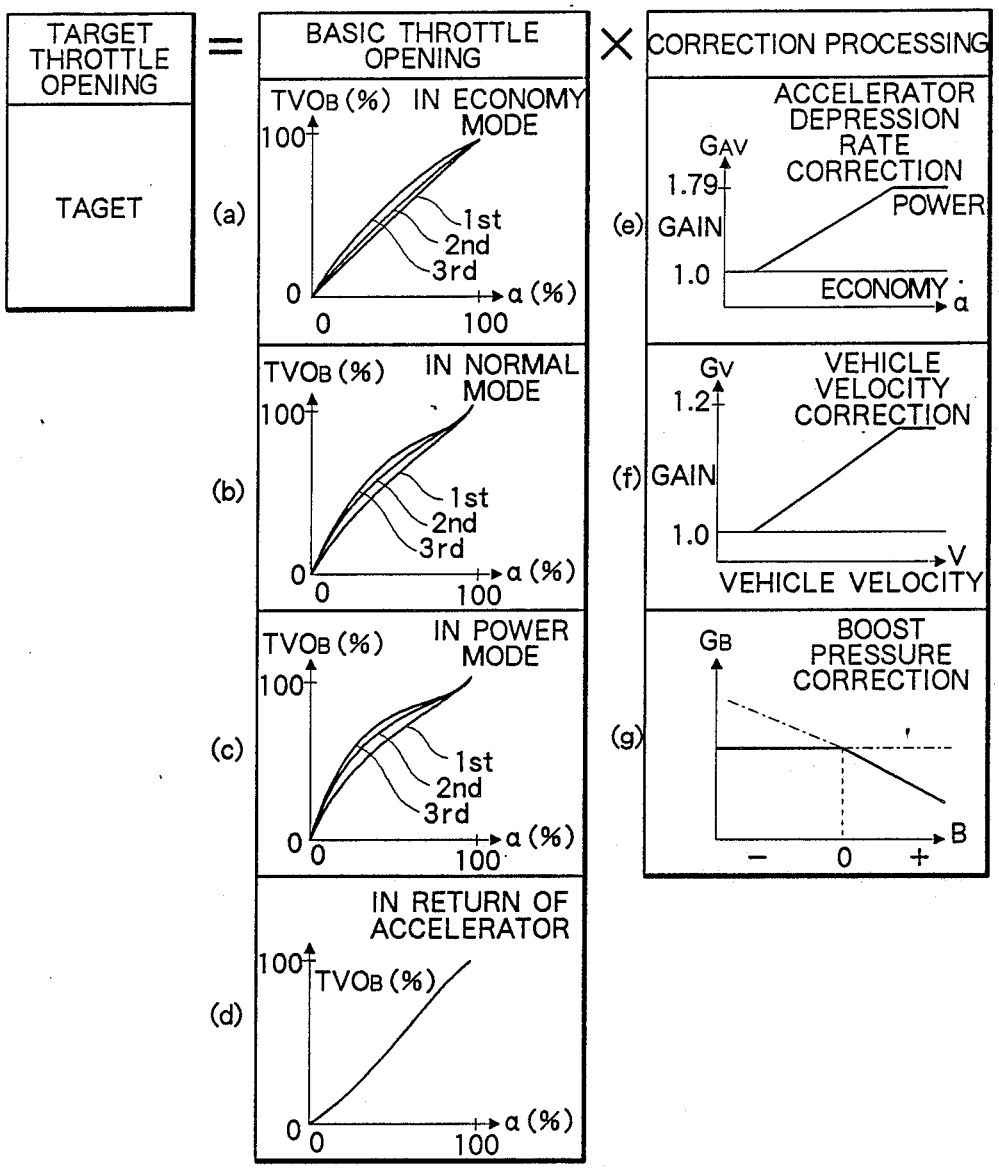
FIGS. 1A and 1B are charts for explaining overall throttle opening arithmetic control according to an embodiment of the present invention.
Figure 1B:
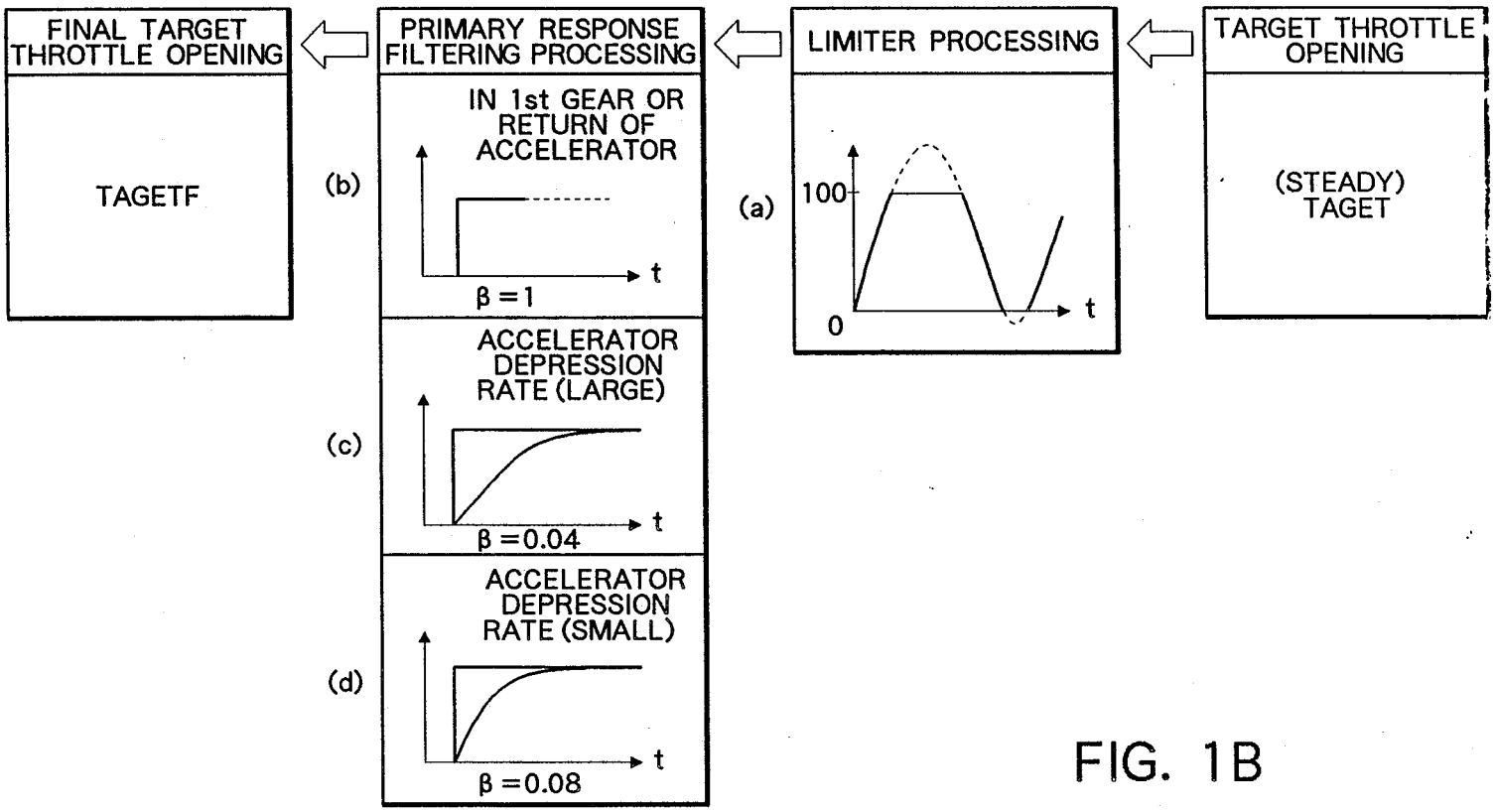

FIGS. 1A and 1B schematically show throttle control in this embodiment. In particular, FIG. 1A shows throttle control in a steady state, and FIG. 1B shows the control in a transient state. Steady characteristics are static characteristics after a transient state of a change in throttle opening upon a change in depression amount of an acceleration pedal is terminated.

Steady State

Determination of a target throttle opening TAGET in a steady travel state will be described with reference to FIG. 1A. The opening TAGET is obtained by determining $TAGET_B$ from a map in accordance with a depression amount $\alpha$ (%) of the acceleration pedal. As shown in FIG. 1A, four kinds of maps are prepared depending on judgement of the operation modes and return of the acceleration pedal as shown in FIGS. 1A(a) to 1A(d). Thus, a basic throttle opening $TVO_B$ is determined. The opening $TVO_B$ is subjected to corrections $G_{AV}$, $G_V$, and $G_B$ determined based on a depression rate of the acceleration pedal, a vehicle velocity V, and a boost pressure B of a supercharger, thereby determining the target throttle opening TAGET.

According to FIG. 1A, basic throttle opening characteristics $TVO_B$ improve response with respect to an operation of the acceleration pedal so that a relatively large throttle opening is obtained for a small change in depression amount of the acceleration pedal in the order of the economy mode (FIG. 1A(a)) → the normal mode (FIG. 1A(b)) → the power mode (FIG. 1A(c)). However, in this state, since a brake power is increased as a gear transmission ratio is increased (in the order of 3rd speed → 2nd speed → 1st speed) in an identical mode, a torque shock easily occurs in this order. Therefore, a throttle gain is set lower as the gear transmission ratio is increased.

During return of the acceleration pedal, since characteristics shown in FIG. 1A(d) are set regardless of mode setting, a change in close amount of the acceleration pedal substantially corresponds to a change in close amount of a throttle valve. Therefore, the vehicle is decelerated as a driver desired in response to the acceleration pedal return operation while the acceleration pedal is relatively deeply depressed.

According to FIG. 1A(e), in the power mode, gain increases as the depression rate $\dot{\alpha}$ of the acceleration pedal is increased, thus responding to a driver's will to accelerate. The fact that the depression rate $\dot{\alpha}$ is large regardless of the depression amount of the acceleration pedal means that the driver wants to accelerate the vehicle.

According to FIG. 1A(f), gain increases as a vehicle velocity is increased.

According to FIG. 1A(g), gain decreases as a boost pressure is increased. If the boost pressure is high, since an engine torque is large, so-called peaky, humped output characteristics inherent to a turbo charger may be obtained. In order to prevent this, correction shown in FIG. 1A(g) is performed to obtain flat output characteristics, thus improving controllability of the vehicle movement.

Thus, the target throttle opening TAGET in the steady state is given by:

$$TAGET = TVO_B \cdot G_{AV} \cdot G_V \cdot G_B$$

Correction factors of the target throttle opening TAGET in the steady state applied to this embodiment include correction based on a cooling water temperature, correction based on an atmospheric pressure, correction based on a steering angle, correction depending on whether or not an air conditioner is operated, and the like. However, these factors are not directly related to the present invention, and a detailed description thereof will be omitted.

Transient State

FIG. 1B shows throttle control in a transient state when an acceleration pedal opening is changed. More specifically, the target opening TAGET which is calculated and obtained for the steady state is corrected to obtain a final target throttle opening TAGETF.

First, the opening TAGET is subjected to limiter processing shown in FIG. 1B(*a*). This processing is performed to prevent the calculated throttle opening TAGET from exceeding 100% or being negative FIGS. 1B(b) to 1B(d) show filtering processing. In this embodiment, a digital primary response filter is used. An abrupt increase in TAGET corresponding to an abrupt increase in acceleration pedal opening is smoothed and moderated by the primary response filter. A coefficient $\beta$ (a reciprocal number of a time constant) of this filter is set as follows:

(1) $\beta=1$ during use of the 1st-speed gear, during return of the acceleration pedal, or during mechanical control when throttle electronic control malfunctions (FIG. 1B(b));

(2) the coefficient $\beta$ is set to be relatively small when the depression rate $\dot{\alpha}$ of the acceleration pedal is large (FIG. 1B(c)); and (3) the coefficient $\beta$ is set to be relatively large when $\dot{\alpha}$ is small (FIG. 1B(d)).

According to FIG. 1B(b), a response delay time is eliminated, and the vehicle sensitively responds to a change in operation of the acceleration pedal. In particular, during use of the 1st-speed gear, a requirement that the start response is of prime importance can be met. When the acceleration pedal is returned, the vehicle sensitively responds without response delay time. Therefore, the vehicle follows the operating will of a driver who intends to decelerate the vehicle. When the depression rate $\alpha$ of the acceleration pedal is large, i.e., in an abrupt acceleration state, since a response delay time is increased, the torque shock is eliminated, and smooth acceleration is attained.

Note that transient characteristic control of the throttle opening shown in FIG. 1B changes depending on several factors, e.g., the 1st-gear, the depression rate $\dot{\alpha}$ of the acceleration pedal, during return of the acceleration pedal or not, and the like. This specification also discloses an embodiment considering the gear position, a setting mode, and the like in FIG. 10C, and so on.

Arrangement of Engine Control System

Figure 2:
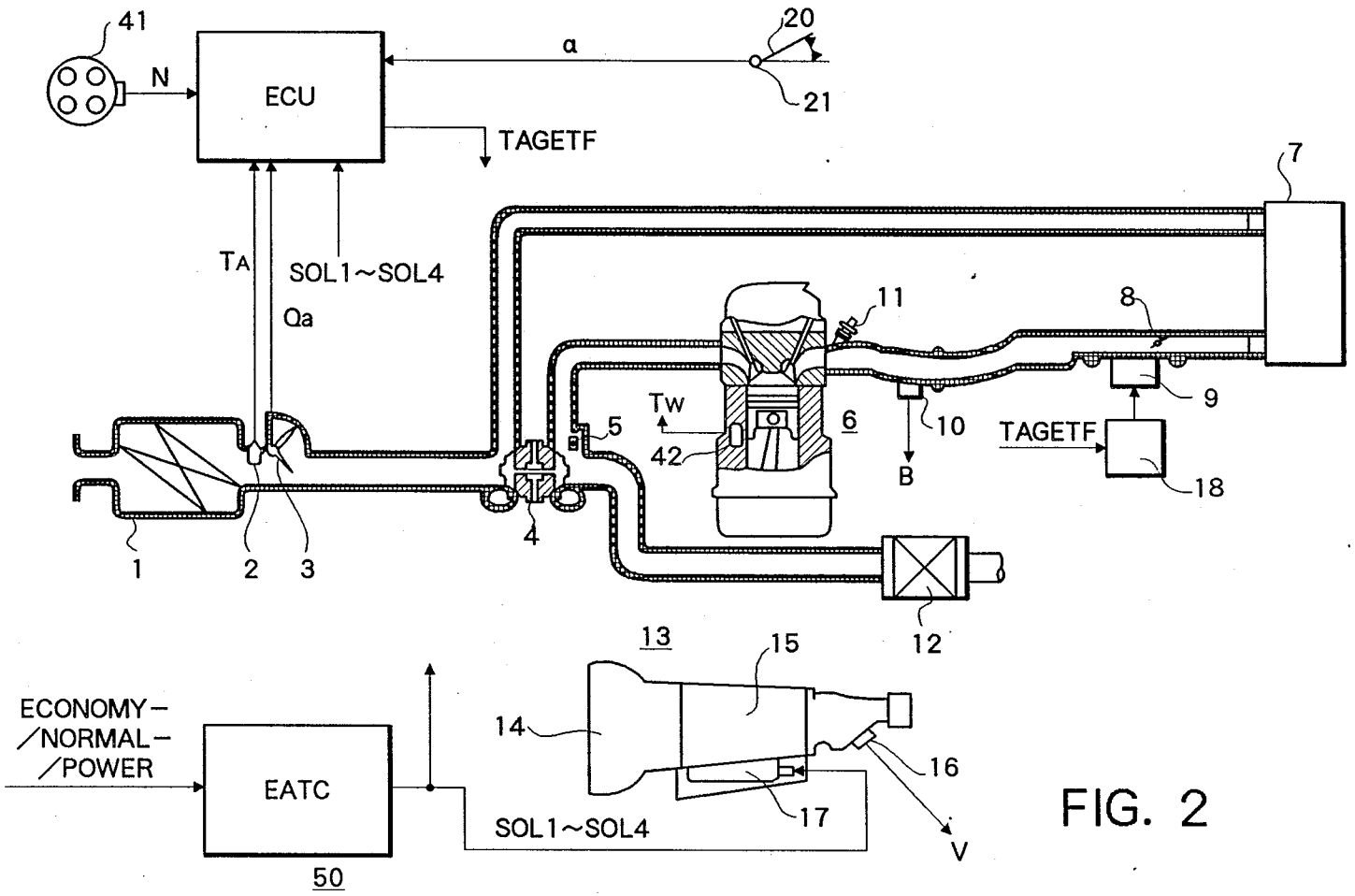
FIG. 2 is a diagram showing an overall engine system to which the present invention is applied.

FIG. 2 is a diagram of an embodiment wherein an engine control apparatus according to the present invention is applied to a turbo-charged engine. Principal constituting elements in FIG. 2 will be explained below.

Reference numeral 1 denotes an air cleaner; 2, a sensor for measuring an intake air temperature; 3, an air flowmeter for measuring a flow rate of intake air; 4, an exhaust gas turbine type supercharger (turbo charger) for rotating a turbine by an exhaust gas and rotating a compressor connected to the turbine to perform supercharging; 5, a waste gate valve for, when a boost pressure exceeds a predetermined value, releasing part of an exhaust gas in order to decrease the boost pressure; 6, an engine body; and 7, an intercooler for cooling intake air in order to improve charging efficiency. Air taken in accordance with supercharging of the turbo charger 4 flows toward an intake manifold of the engine body while its flow rate Qa is measured by the air flowmeter 3 and being cooled by the intercooler 7.

Reference numeral 8 denotes a throttle valve; 9, an actuator for driving the throttle valve; 10, a boost pressure sensor for measuring a pressure in the intake manifold; and 11, an injector for injecting a fuel. The intake air is mixed with the fuel injected from the injector 11, and the air-fuel mixture is fed to a combustion chamber of the engine body 6 to be combusted. An exhaust gas flows through an exhaust path, and is applied to the turbo charger 4 while its energy is converted to rotation energy. In addition, the exhaust gas is exhausted after it is cleaned by a catalytic converter 12.

Reference numeral 13 denotes an electronically controlled automatic transmission system, a so-called EAT. The EAT 13 is controlled by an EAT controller (EATC) 50. As is well known, the EAT 13 comprises a torque converter 14, planet gears 15 with an automatic drive mechanism, and a hydraulic controller 17 including solenoid valves for these gears, a hydraulic circuit, and the like. A signal for energizing/deenergizing the solenoid valves to drive the hydraulic circuit, a shift signal (SOL1 to SOL4; to be described later) indicating a shift result state in response to the above signal, and the like are exchanged between the EATC 50 and the EAT 13. A sensor 16 for detecting the vehicle velocity V is attached to the output shaft of the EAT.

Reference numeral 18 denotes a throttle controller incorporating a servo control circuit for controlling a DC servo motor for driving the throttle valve. Note that the servo motor is arranged in the throttle actuator 9. Reference numeral 20 denotes an acceleration pedal; and 21, an acceleration pedal position sensor for detecting a depression amount of the acceleration pedal.

Associated Switches

Figure 3A:
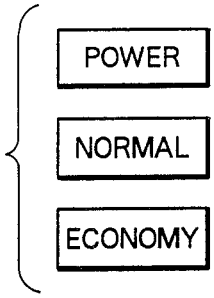
FIGS. 3A and 3B are views for explaining switches used in a vehicle of the embodiment shown in FIG. 2.
Figure 3B:
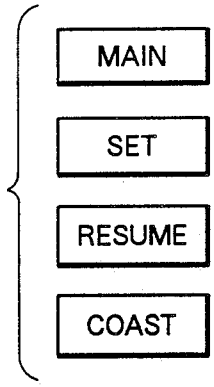

FIG. 3A shows switches for selecting the above-mentioned operation modes (power, normal, and economy modes). FIG. 3B shows switches for a so-called automatic travel (auto cruise) function. A "MAIN" switch is used for powering a controller for controlling an auto cruise operation (ASC=Auto Speed Controller), a "SET" switch is used for setting a cruise speed and for increasing the speed when this switch is kept depressed for a predetermined period of time, a "RESUME" switch is used for, once the auto cruise mode is canceled, then resuming this mode to resume the immediately preceding cruise speed, and a "COAST" switch is used for completely closing the throttle valve.

Throttle Sensor/Actuator

Figure 4:
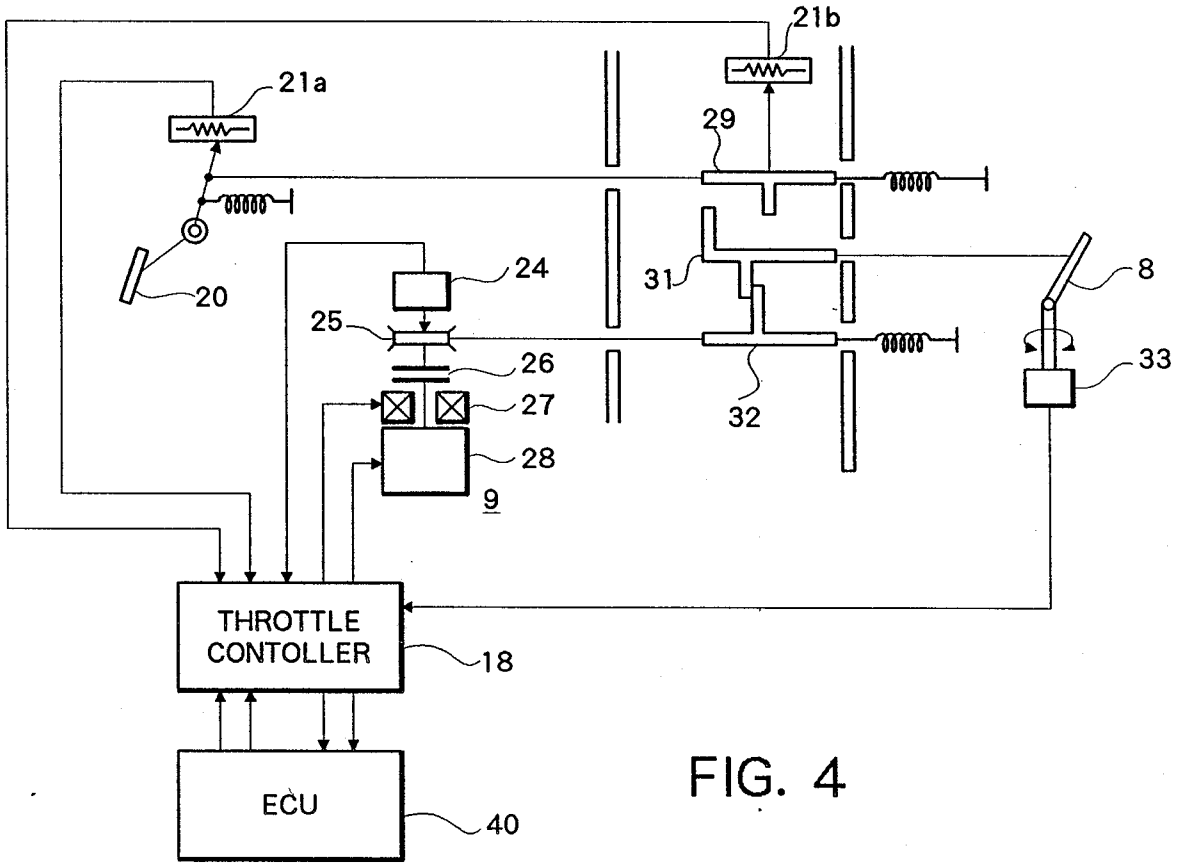
FIG. 4 is a diagram for explaining the relationship between a throttle actuator and a throttle controller.

FIG. 4 shows an arrangement of a throttle sensor/actuator assembly used in the engine system of this embodiment. The sensor/actuator has a so-called fail-safe function in consideration of an importance of the role of the throttle valve in the vehicle.

In FIG. 4, reference numeral 8 denotes the throttle valve; 9, the throttle actuator; 18, the throttle controller; and 20, the acceleration pedal. These components have already been explained with reference to FIG. 2. Two acceleration pedal position sensors 21 for detecting the depression amount of the acceleration pedal are arranged for the fail-safe function. A sensor 21*a* is a main sensor, and a sensor 21*b* is a backup sensor. These sensors have a potentiometer structure, and their outputs correspond to a voltage valve obtained by converting a percentage of an actual acceleration pedal depression amount with respect to a full depression amount of the acceleration pedal into a voltage. Reference numeral 29 denotes a pulley linked with the acceleration pedal 20 through a wire; and 31, an engaging member linked with the throttle valve 8. The position sensor 21*a* is used as the main sensor since it does not have a play due to a wire cable like in the sensor 21*b*.

The throttle actuator 9 consists of a servo motor 28, a solenoid 27, a pulley 25, an electromagnetic clutch 26 for transmitting a rotational force of the DC servo motor 28 when the solenoid 27 is energized, a rotation sensor 24 for detecting a rotational amount and a rotational speed of the pulley 25 for servo control and feeding back these values to the throttle controller 18, and the like. The pulley 25 is linked with a pulley 32 through a wire. Note that the pulleys 29 and 32 and the engaging member 31 are pivoted about an identical rotating shaft. However, in FIG. 4, the rotation is illustrated as a linear movement for the sake of simplicity. A throttle sensor 33 detects a full-open or full-closed state of the throttle valve 8, and a throttle opening when the throttle valve 8 is directly driven by the pulley 29.

There is a play to a position where the pulley 29 is engaged with the engaging member 31. Normally, the engaging member 31 is engaged with the pulley 32. When an ECU (engine controller unit) 40 judges "OK" by its self diagnosis function, the clutch 26 is in an engaged state. Therefore, when the acceleration pedal 20 is depressed, the depression amount $\alpha$ of the acceleration pedal is detected by the sensor 21*a*, and at the same time, the signal $\alpha$ is sent to the ECU 40 through the throttle controller 18. The ECU 40 immediately calculates the final target throttle opening TAGETF by control (to be described later), and sends the calculation result to the throttle controller 18. The throttle controller 18 rotates the motor 28 by electrical power according to the value TAGETF, and performs servo control so that the motor 28 is set at a predetermined rotational position based on the feedback signal from the sensor 24. More specifically, since the servo motor is rotated by an amount corresponding to the value TAGETF to rotate the pulley 32, the engaging member 31 is rotated since it is engaged with the pulley 32. Thus, the throttle valve 8 is opened by an amount corresponding to the value TAGETF. When the engaging member 31 is rotated, it is escaped from the pulley 29. Therefore, in a normal state, the throttle valve 28 will not be directly opened/closed by the pulley 29.

When the ECU 40 judges by its self diagnosis function that a control circuit associated with throttle control is abnormal, the electromagnetic clutch 26 is disengaged. In this case, since the pulley 29 and the engaging member 31 are engaged after the acceleration pedal is depressed by an amount corresponding to a predetermined play, the throttle valve 8 is then directly opened/closed by mechanical engagement with the acceleration pedal.

ECU 40

Figure 5:
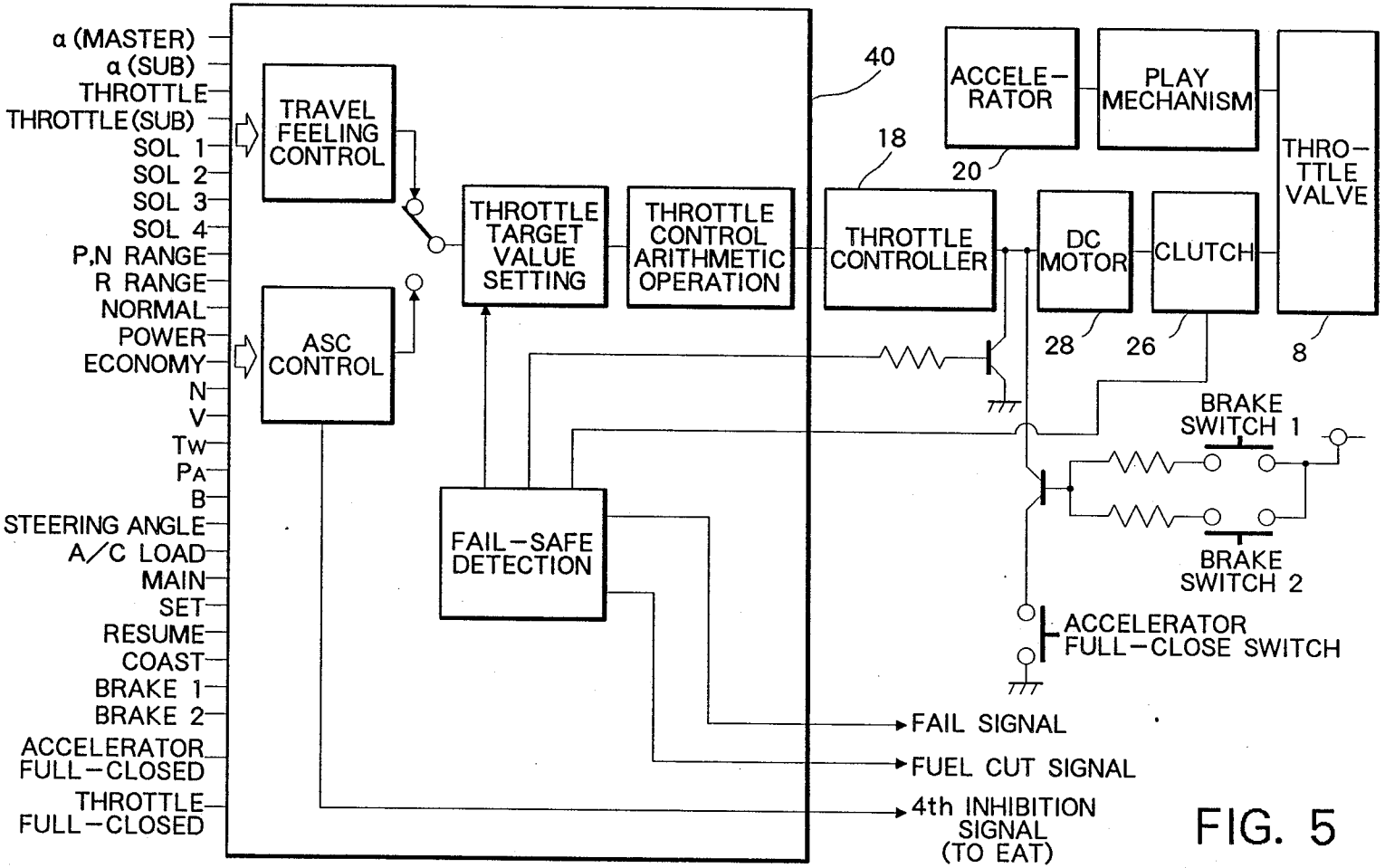
FIG. 5 is a signal chart of an engine controller unit (ECU) 40.

FIG. 5 shows I/0 signals of the ECU 40.

Reference symbols $\alpha$ (master) and $\alpha$ (sub) denote depression amounts of the acceleration pedal from the throttle actuator. Reference symbols THROTTLE and THROTTLE (sub) denote throttle openings measured by the throttle sensor 33.

Transmission solenoid signals SOL1 to SOL4 are supplied from the EATC 50, and indicate the present transmission position corresponding to one of the 1st to 4th speeds. P, N, and R range signals indicate a selected position from a known selector lever (not shown). Normal, power, and economy mode signals are supplied from the switches shown in FIG. 3A. MAIN, SET, RES, and COAST signals are supplied from the switches shown in FIG. 3B.

An engine speed N is obtained from a distributor 41, a vehicle velocity signal V is obtained from the vehicle velocity sensor 16, a cooling water temperature signal $T_W$ is obtained from a water temperature sensor 42, an atmospheric pressure signal $P_A$ is obtained from an atmospheric pressure sensor (not shown), the boost pressure B is obtained from the boost sensor 10, a steering angle signal is obtained from a steering angle sensor (not shown), and an A/C load signal is obtained from an air conditioner (not shown).

The ECU 40 outputs the TAGETF, a signal for forcibly turning off energization to the DC servo motor 28, a signal for disengaging the clutch 26, and the like.

In addition, two systems of brake switches are arranged for the fail-safe function. When a brake pedal is depressed, the acceleration pedal is fully returned. Thus, energization to the servo motor 28 is turned off by a circuit shown in FIG. 6. More specifically, the throttle valve is fully closed forcibly without arithmetic control by the ECU 40.

Some control functions of the ECU 40, which are particularly related to the present invention, are illustrated in the blocks of the ECU 40 in FIG. 5. The functions include travel feeling control, ASC control, target throttle value control, and throttle arithmetic control. The travel feeling control is to set an optimal throttle opening in accordance with the gear position, travel mode, and the like, based on the depression amount of the acceleration pedal. More specifically, control matching with travel feeling of a driver is performed. In addition, the ECU 40 has the fail-safe function.

Note that in FIG. 5, target throttle value setting control selects one of inputs from the travel feeling control and the ASC control. This is because the travel feeling control determines the target throttle opening based mainly on the depression amount of the acceleration pedal by a driver, while in the auto cruise mode, the throttle opening is determined based mainly on the preset vehicle velocity and the actual vehicle velocity regardless of the operation of the acceleration pedal by the driver.

Figure 6:
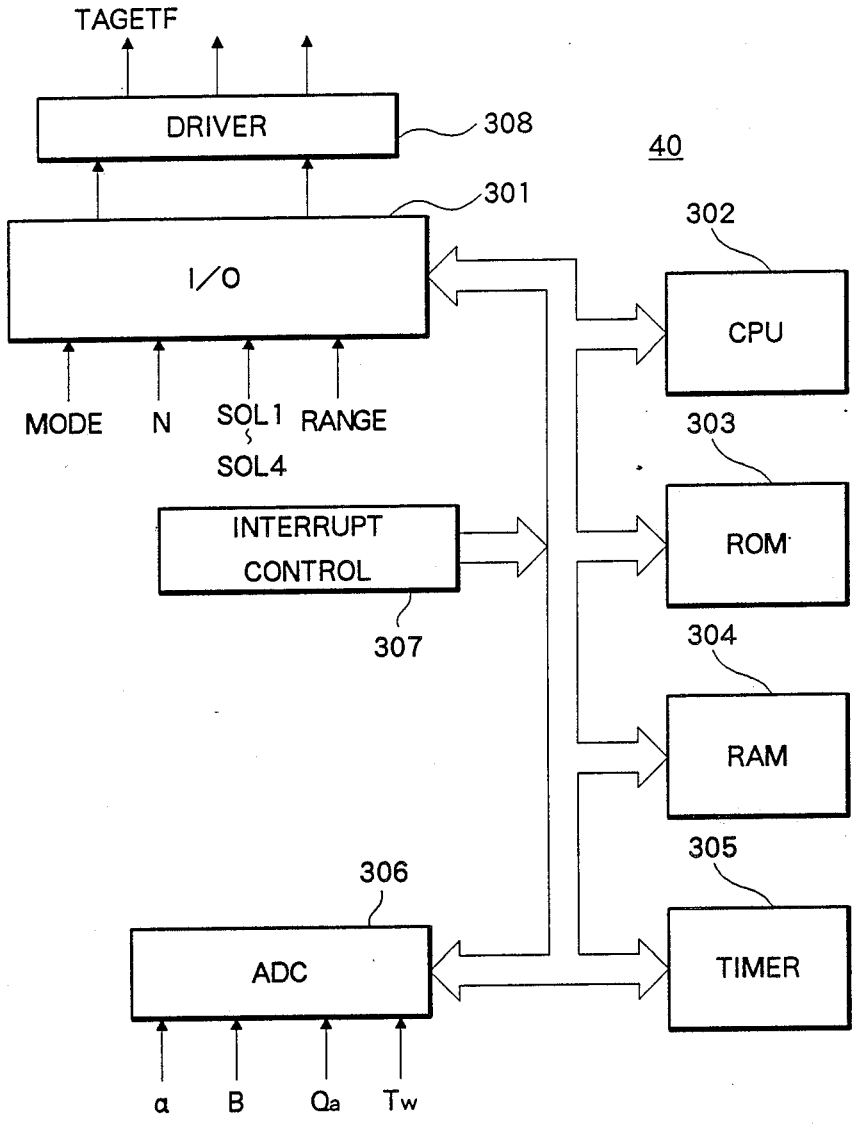
FIG. 6 is a diagram showing an internal arrangement of the ECU 40.

FIG. 6 is a block diagram showing an internal arrangement of the ECU 40 for performing throttle control. Reference numeral 301 denotes an input/output (I/O) port; and 302, a CPU such as a microprocessor. An output port portion of the I/O port 301 is of a latch type, and is connected to a driver 308. Reference numeral 303 denotes a ROM storing a control program, maps, and the like (to be described later) according to the embodiment; 304, a RAM for temporarily storing various data used for control; 305, a program timer for setting a time for timer interrupt; and 306, an A/D converter (ADC) for converting the depression amount $\alpha$ of the acceleration pedal and the like into a digital value. Reference numeral 307 denotes an interrupt controller.

Summary of Throttle Control

Figure 7:
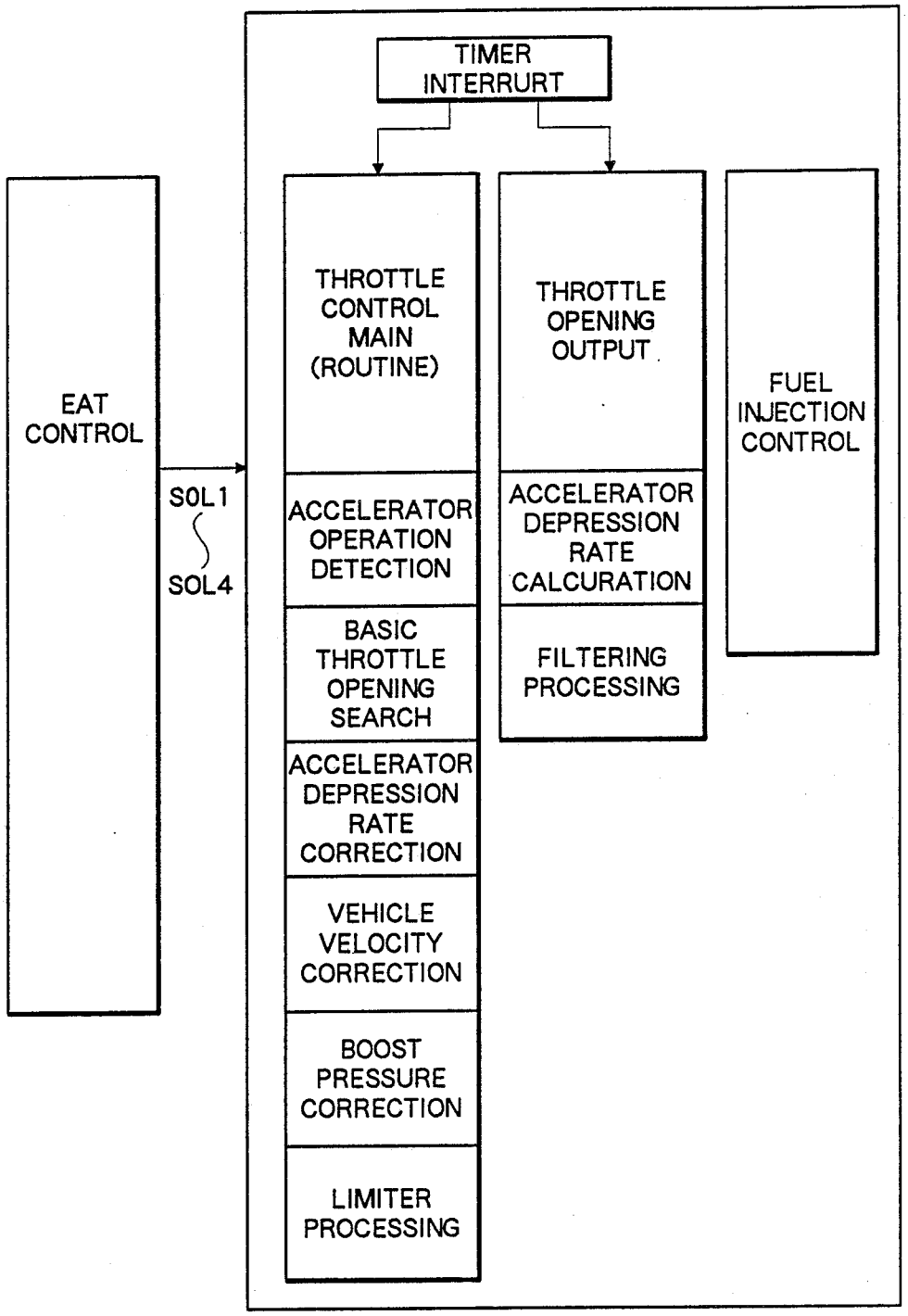
FIG. 7 is a chart showing the relationship between engine control and automatic transmission control.

FIG. 7 shows the relationship among control programs particularly related to this embodiment in the engine control system shown in FIG. 2. Of the control programs shown in FIG. 7, in this specification, details of portions associated with EAT control and fuel control are not related to the present invention, and are omitted. The control program portions particularly related to the present invention are a throttle control main routine shown in FIG. 7 (shown in FIG. 8 and the subsequent figures in detail) and a throttle opening output routine (shown in FIG. 9 and the subsequent figures in detail). The former routine is started in response to timer interrupt every 30 ms, and the latter routine is started in response to timer interrupt every 15 ms. These time intervals are merely examples. For example, a control interval of 30 ms of the main routine may be determined in accordance with an updating period of the target throttle opening so that a driver does not feel uneasy.

Figure 8:
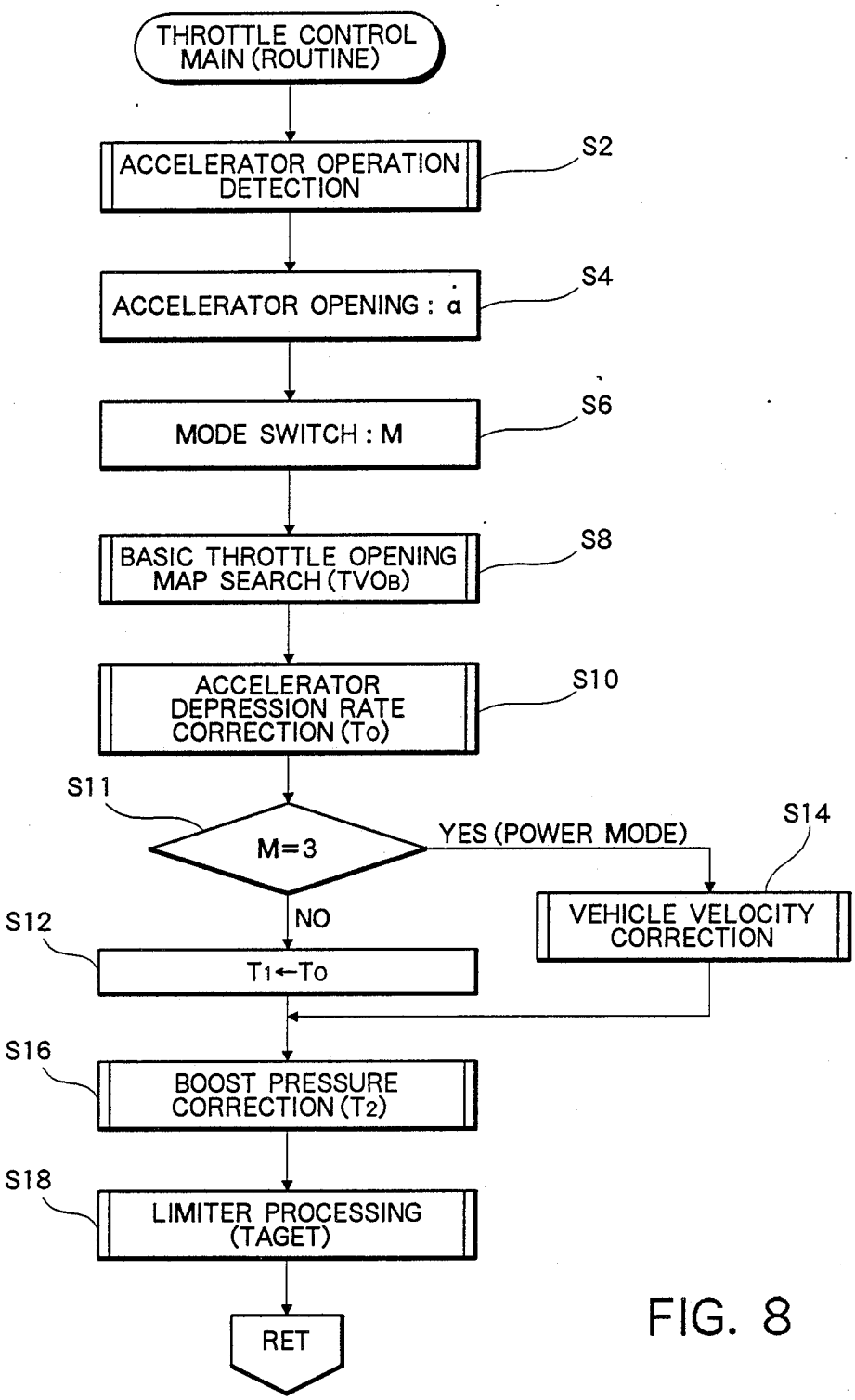
FIG. 8 is a flow chart of a main routine of a throttle control program.

FIG. 8 shows subroutines called by these two interrupt routines.

Figure 8A:
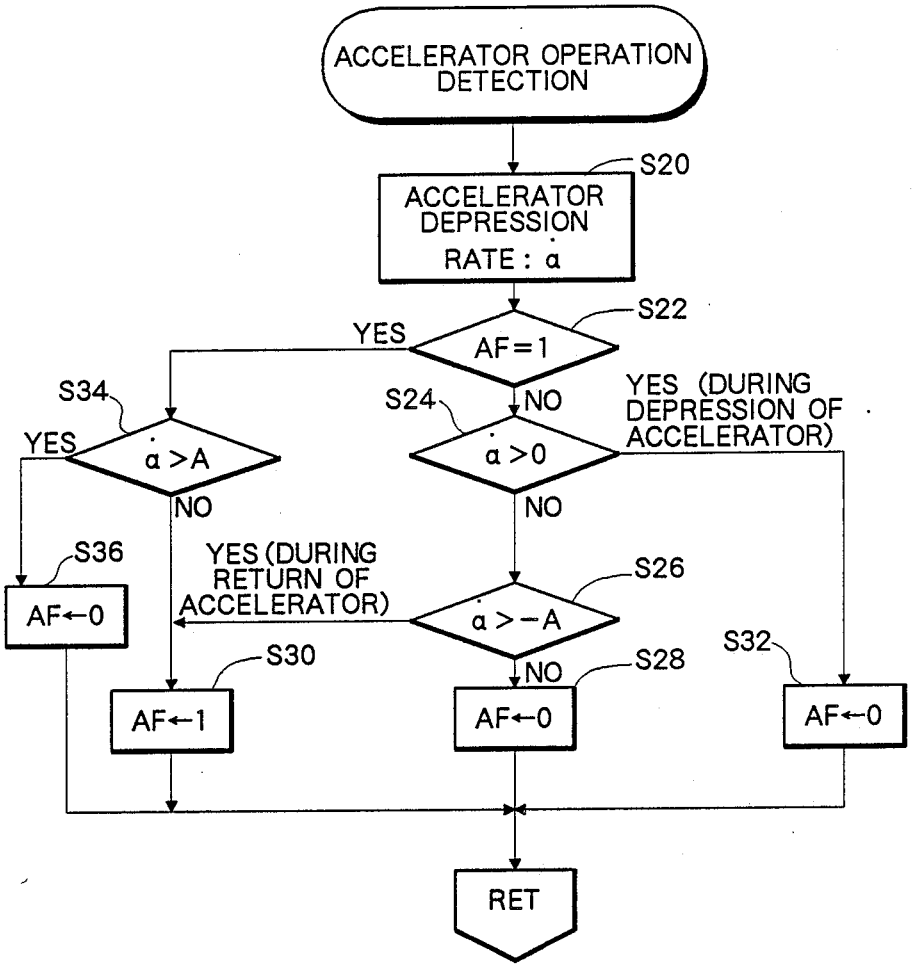
FIG. 8A is a flow chart of an acceleration pedal operation detection control program.

The throttle control main routine will be briefly described below with reference to FIG. 8. As has been described above, the main routine is started by timer interruption every 30 ms. In step S2, the operation of the acceleration pedal by the driver is detected. The acceleration pedal operation detection subroutine is shown in FIG. 8A in detail. In steps S4 and S6, the acceleration pedal opening $\alpha$ and mode M detected in a timer interrupt routine (FIG. 9; to be described later) every 15 ms are read out from a memory. In step S8, a basic throttle opening map (stored in the ROM 303) is searched based on the readout signals, thus determining $TVO_B$. The $TVO_B$ search control in step S8 corresponds to FIGS. 1A(a) to 1A(d), and is shown in FIG. 8C in detail.

The $TVO_B$ obtained in step S8 is subjected to acceleration pedal depression rate correction in step S10, thus obtaining an output $T_0$. The correction processing in step S10 corresponds to FIG. 1A(*e*), and is shown in FIG. 8D in detail.

Then check is made in step S11 if the present operation mode corresponds to the power mode (M=3). If YES in step S11, correction according to the vehicle velocity is performed in step S14 to obtain a throttle opening $T_1$. The vehicle velocity correction corresponds to FIG. 1A(f), and is shown in FIG. 8E in detail.

In step S16, boost pressure correction is performed. This correction corresponds to FIG. 1A(g), and is shown in FIG. 8F in detail. In step S18, limiter processing is performed. The limiter processing corresponds to FIG. 1B(a), and is shown in FIG. 8G in detail.

In this manner, the throttle opening TAGET in the steady state corresponding to an opening $\alpha$ of the acceleration pedal depressed to a given depression position in a given operation mode and in a given gear position state is calculated.

Figure 9:
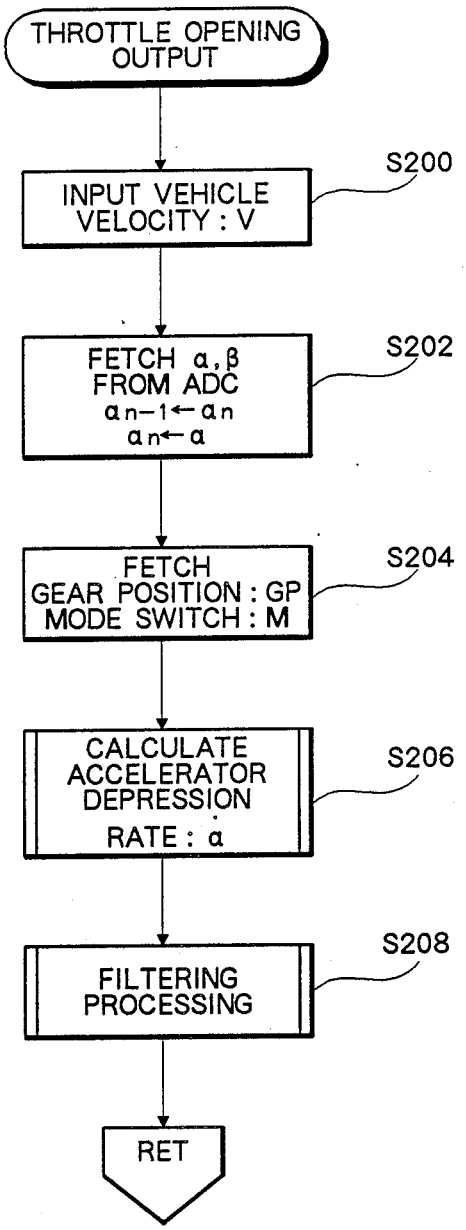
FIG. 9 is a flow chart of a throttle opening output routine control program.

The throttle opening output routine will be briefly described below with reference to FIG. 9. This routine is started every 15 ms, and its output routine includes control (filtering processing) for an initial period (transient period) when the acceleration pedal opening $\alpha$ is changed. In step S200, the vehicle velocity V from the vehicle velocity sensor 16 is inputted, and in step S202, the acceleration pedal opening $\alpha$ and the boost pressure B from the A/D converter 306 are input. For a later arithmetic operation, the immediately preceding acceleration pedal opening value (15 ms before) is stored in $\alpha_{n-1}$, and the currently measured value $\alpha$ is stored in $\alpha_n$. Note that in step S204, the transmission gear position GP and the mode switch positon are fetched from the input port 301 in the RAM 304.

GP=1 (SOL1, 1st speed)
GP=2 (SOL2, 2nd speed)
GP=3 (SOL3, 3rd speed)
GP=4 (SOL4, 4th speed)
M=3 (power mode)
M=2 (normal mode)
M=1 (economy mode)

Figure 9A:
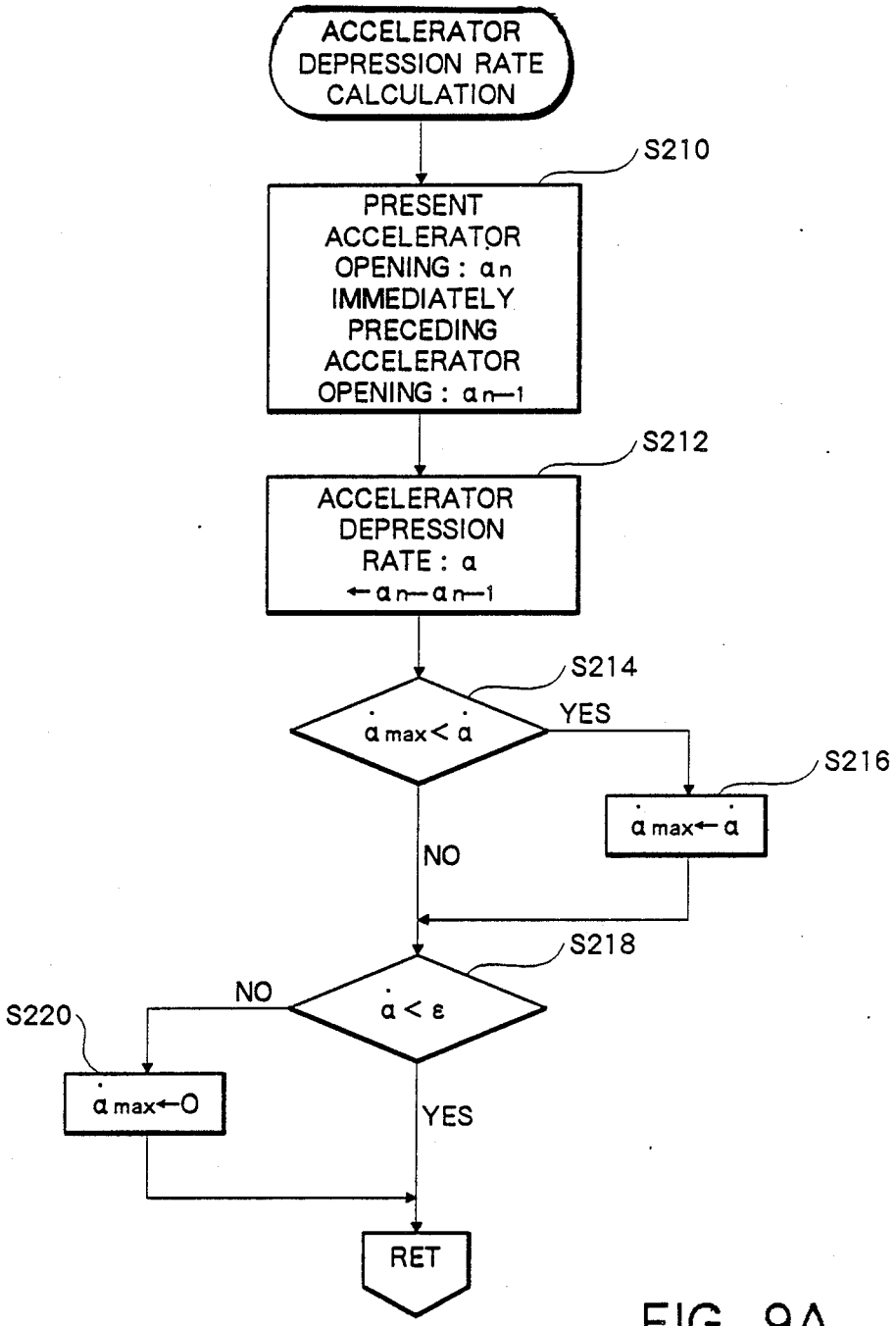
FIG. 9A is a flow chart of an acceleration pedal depression rate calculation control program.

These data stored in the RAM 304 are used in various steps in other control programs. In step S206, a depression rate $\dot{\alpha}$ of the acceleration pedal is calculated. The arithmetic operation routine is as shown in FIG. 9A. For the sake of description, the acceleration pedal depression rate calculation routine will be described first.

Acceleration Pedal Depression Rate Calculation

In step S210 of FIG. 9A, the present acceleration pedal opening $\alpha_n$ and the immediately preceding acceleration pedal opening $\alpha_{n-1}$ are read out from the RAM. In step S212, the acceleration pedal depression rate $\dot{\alpha}$ is calculated according to the following equation:

$$\dot{\alpha}=\alpha_n-\alpha_{n-1}$$

More specifically, a change in opening for 15 ms is determined as an acceleration pedal depression rate. Note that in order to accurately grasp the driver's will, the present opening may be compared with data 60 ms before the present final, i.e., $\alpha_{n-4}$. That is, $$\dot{\alpha}=\alpha_n-\alpha_{n-4}$$

This time interval is preferably as short as possible in order to accurately grasp the driver's will and to feed back the will to the control as fast as possible.

In step S214, $\dot{\alpha}_{max}$ is compared with $\dot{\alpha}$. $\dot{\alpha}_{max}$ is a maximum $\dot{\alpha}$ value in one acceleration pedal operation cycle wherein the acceleration pedal is kept depressed at a given depression rate.

$$\text{If } \dot{\alpha}>\dot{\alpha}_{max}$$

$\dot{\alpha}_{max}$ is updated by the present $\dot{\alpha}$ in step S216. That is, $$\dot{\alpha}_{max}\leftarrow\dot{\alpha}$$

In step S218, $\alpha$ is compared with a predetermined small constant $\epsilon$. If $\dot{\alpha}$ is smaller than $\epsilon$, that is, $$\text{if } \dot{\alpha}<\epsilon$$

this represents a state wherein the acceleration pedal is returned or depression of the acceleration pedal is interrupted (the acceleration pedal is almost stopped). In this case, in step S220, $\dot{\alpha}_{max}$ is set to be "0". With this control, $\dot{\alpha}_{max}$ having a value other than "0" indicates a maximum acceleration pedal depression rate in the acceleration pedal operation, i.e., when the acceleration pedal is kept depressed ($\alpha$ is linearly increased).

$\dot{\alpha}$ and $\dot{\alpha}_{max}$ calculated in the acceleration pedal depression rate subroutine are stored in the RAM 304 for use in other routines.

Referring back to FIG. 9, in step S208, response processing for a transient period of a change in operation of the acceleration pedal is performed to calculate a final target throttle opening TAGETF, and the opening TAGETF is output to the throttle actuator 9. This processing corresponds to FIGS. 1B(b) to 1B(d), and is shown in FIG. 9B in detail.

Figure 9B:
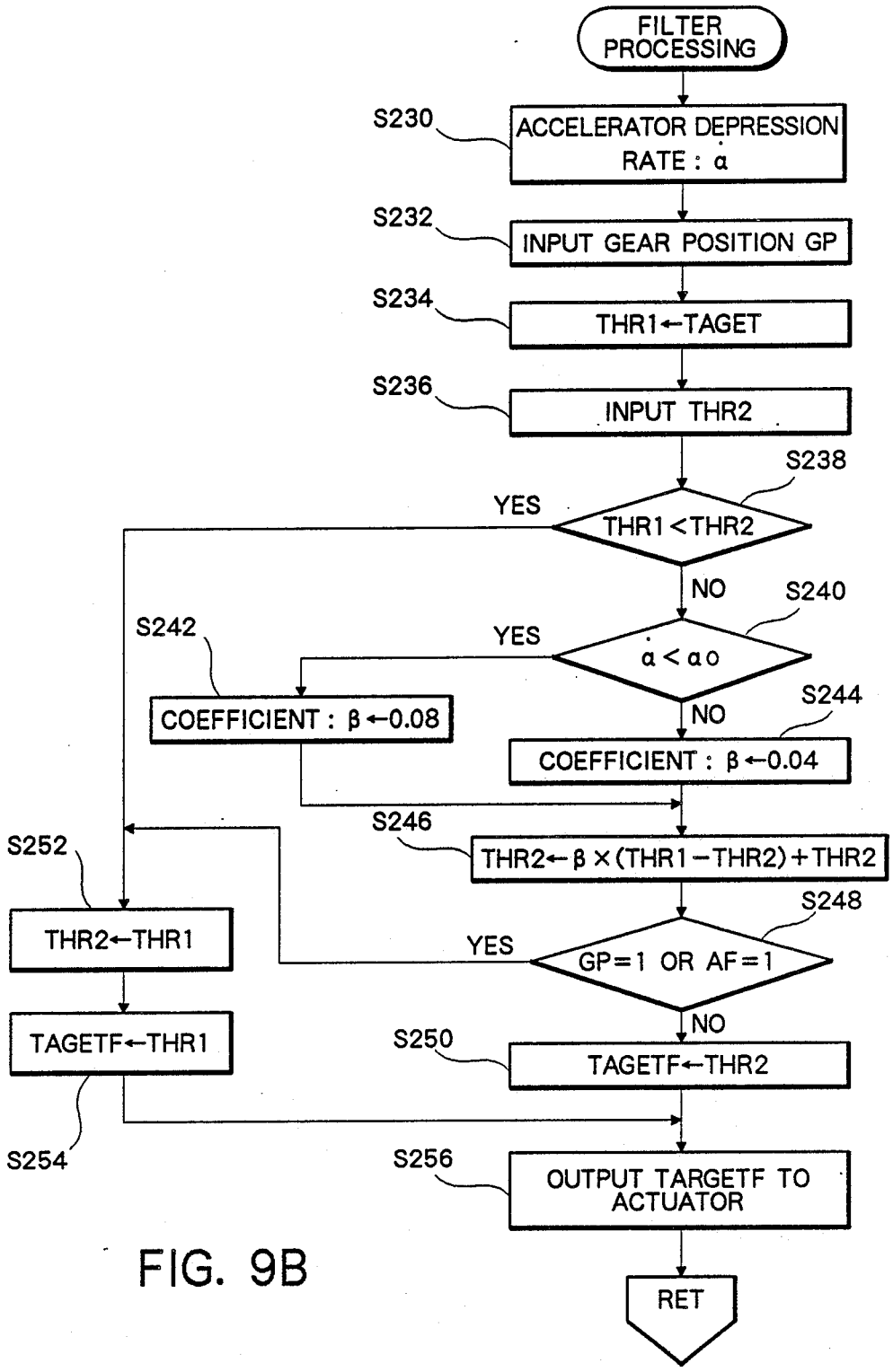
FIG. 9B is a flow chart of a control program of response delay processing according to a basic mode.
Figure 9C:
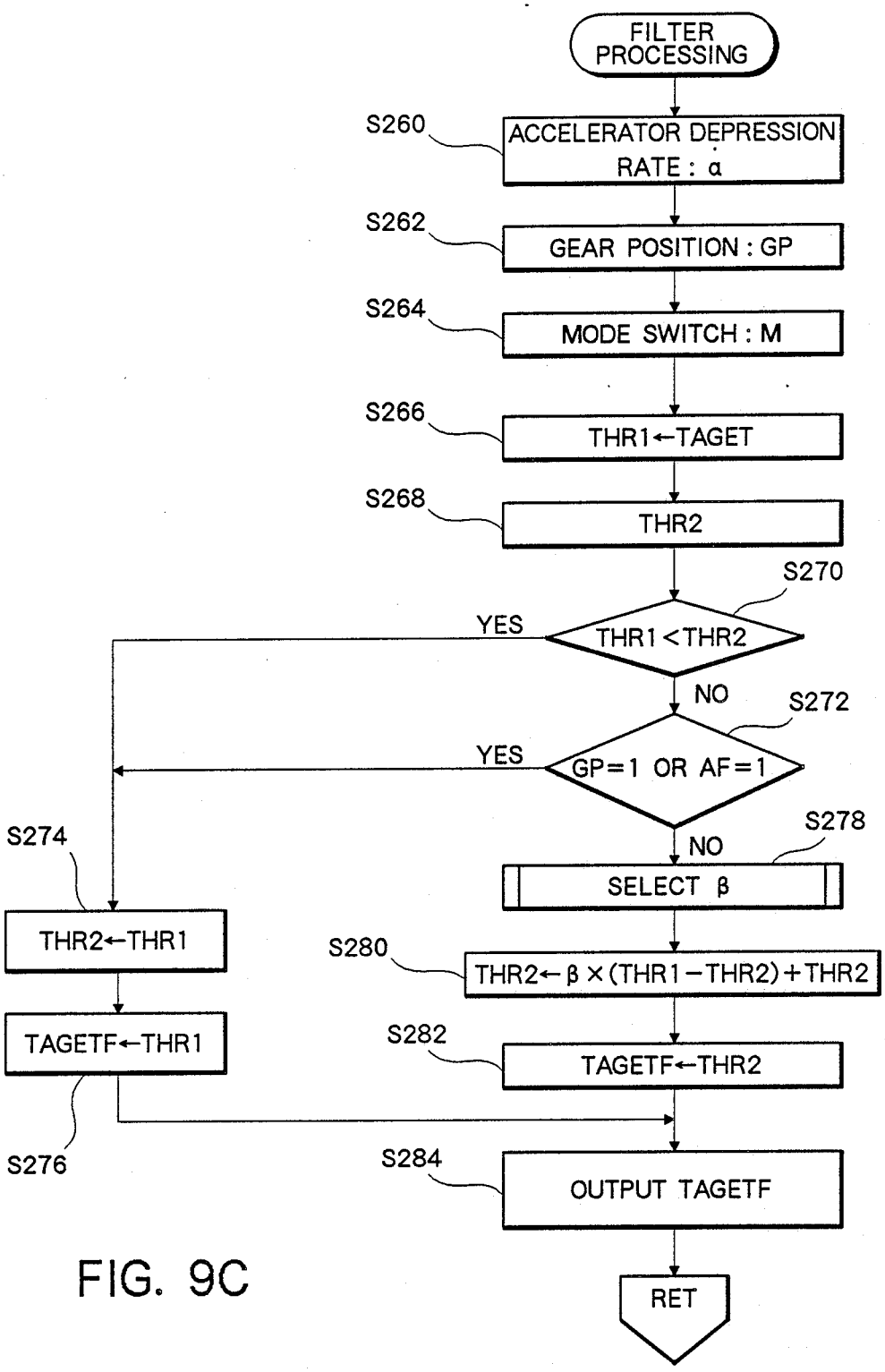
FIGS. 9C and 9D are flow charts of a control program of response delay processing according to modifications.

Note that FIG. 9B is one mode of transient response processing, and its modification is shown in FIG. 9C.

Throttle opening control will be described in detail below with reference to the corresponding flow charts.

DETAILED DESCRIPTION OF THROTTLE CONTROL IN STEADY STATE

Acceleration Pedal Operation Detection (FIG. 8A)

In step S20, the depression rate $\dot{\alpha}$ of the acceleration pedal is read out from the RAM 304, and in step S22, a flag AF is checked. The flag AF is reset to be "0" in an initial state. When the acceleration pedal return operation is detected, the flag AF is set to be "1". The acceleration pedal operation detection is necessary for updating a basic throttle opening map in the return state of the acceleration pedal and in transient processing of TAGETF (steps S44 and S46 in FIG. 8C and step S248 in FIG. 9B).

Figure 8B:
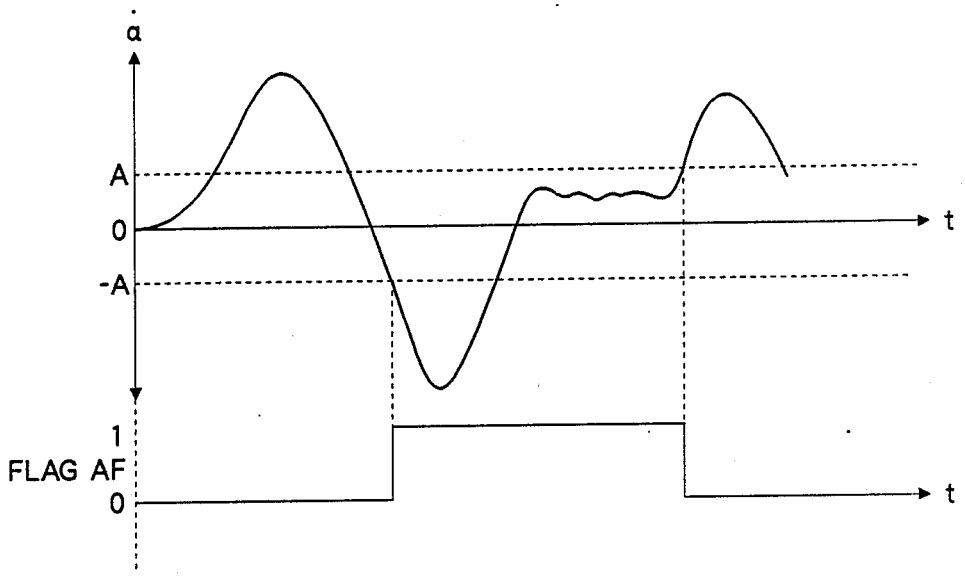
FIG. 8B is a graph showing a detailed relationship between an operation of an acceleration pedal and a flag AF.
Figure 8C:
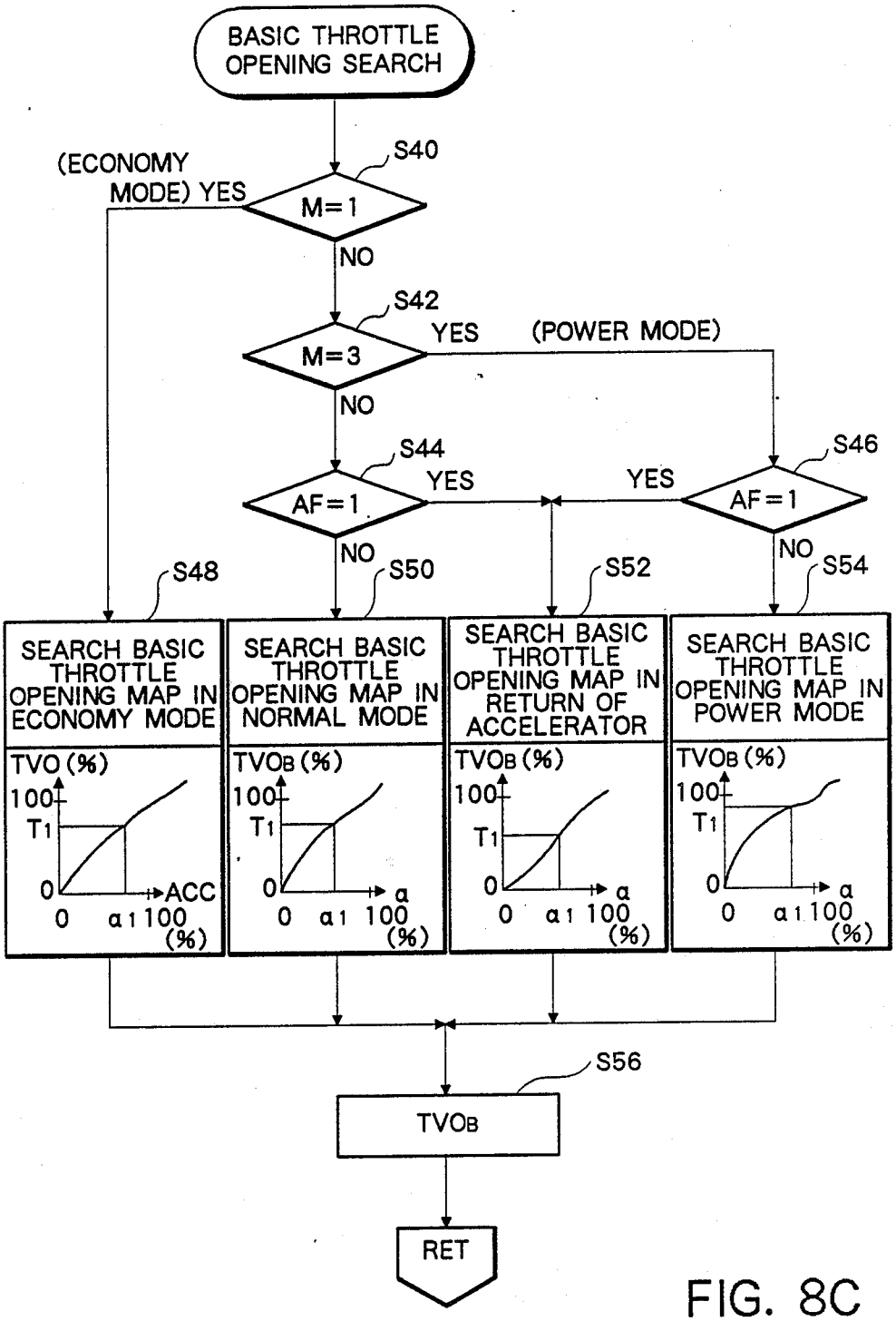
FIG. 8C is a flow chart of a basic throttle opening map search control program.
Figure 8D:
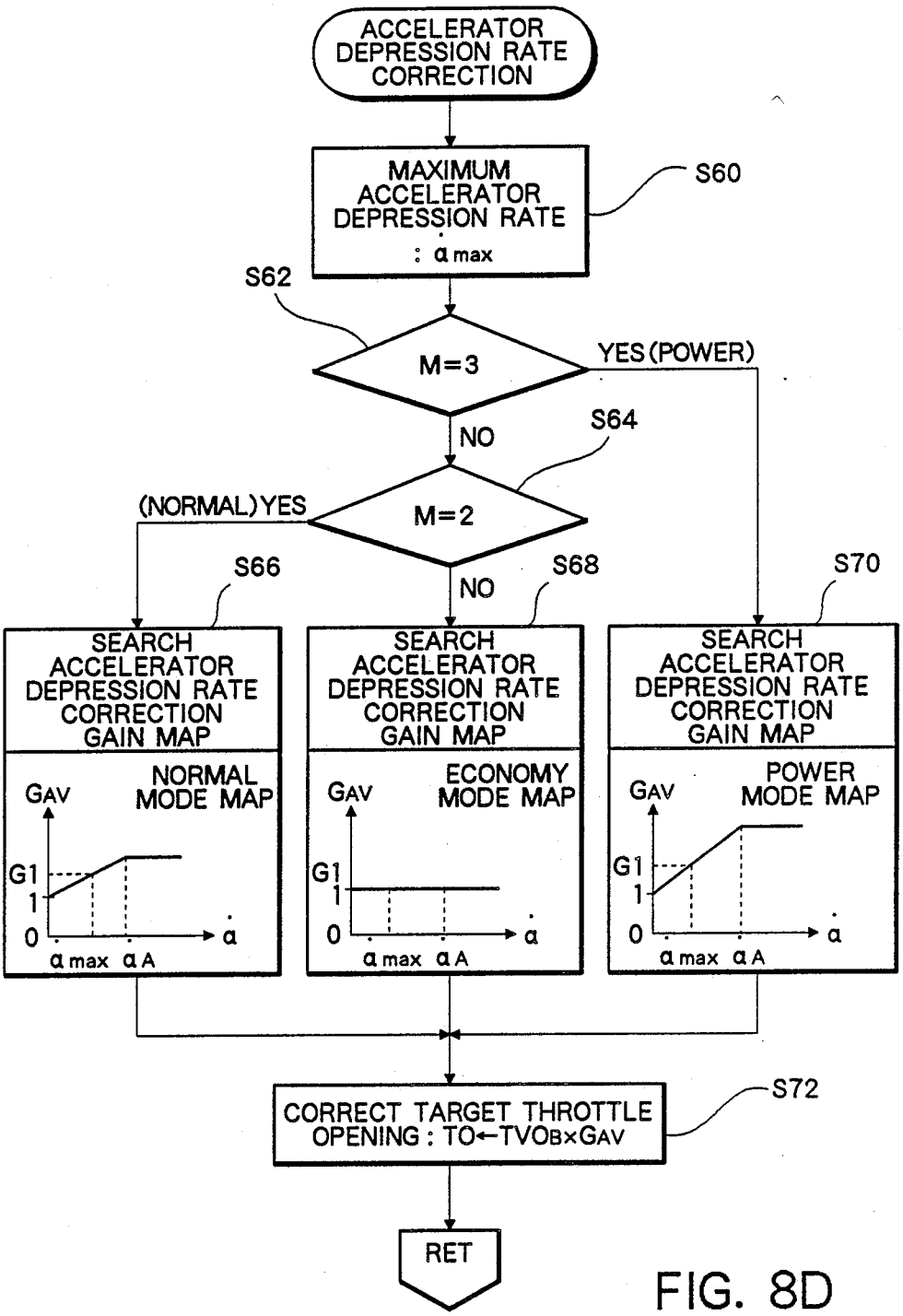
FIG. 8D is a flow chart of an acceleration pedal depression rate correction control program.
Figure 8E:
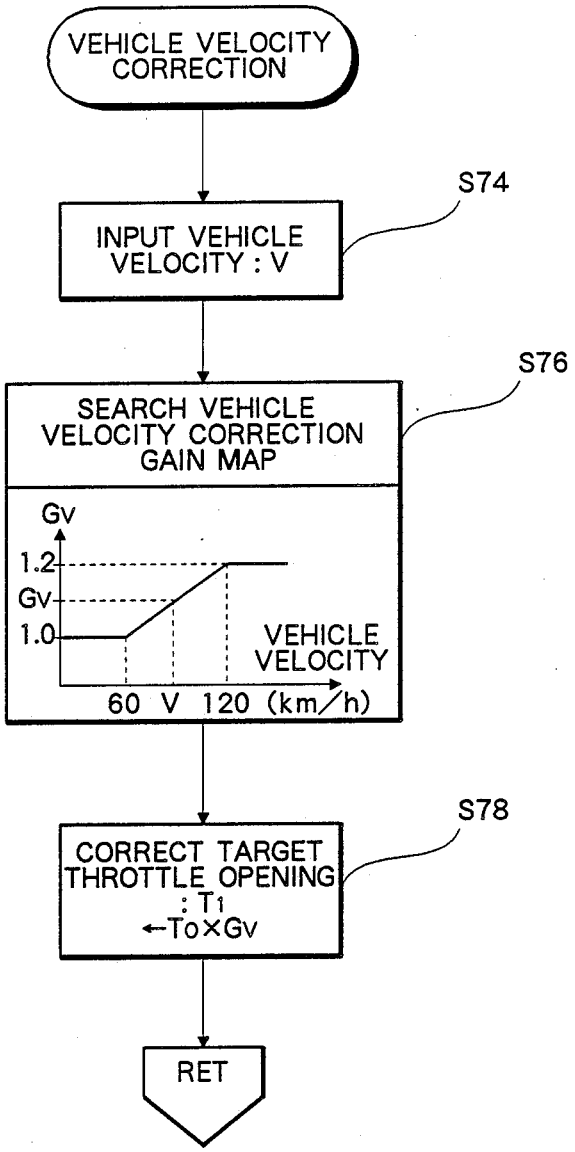
FIG. 8E is a flow chart of a vehicle velocity correction control program.
Figure 8F:
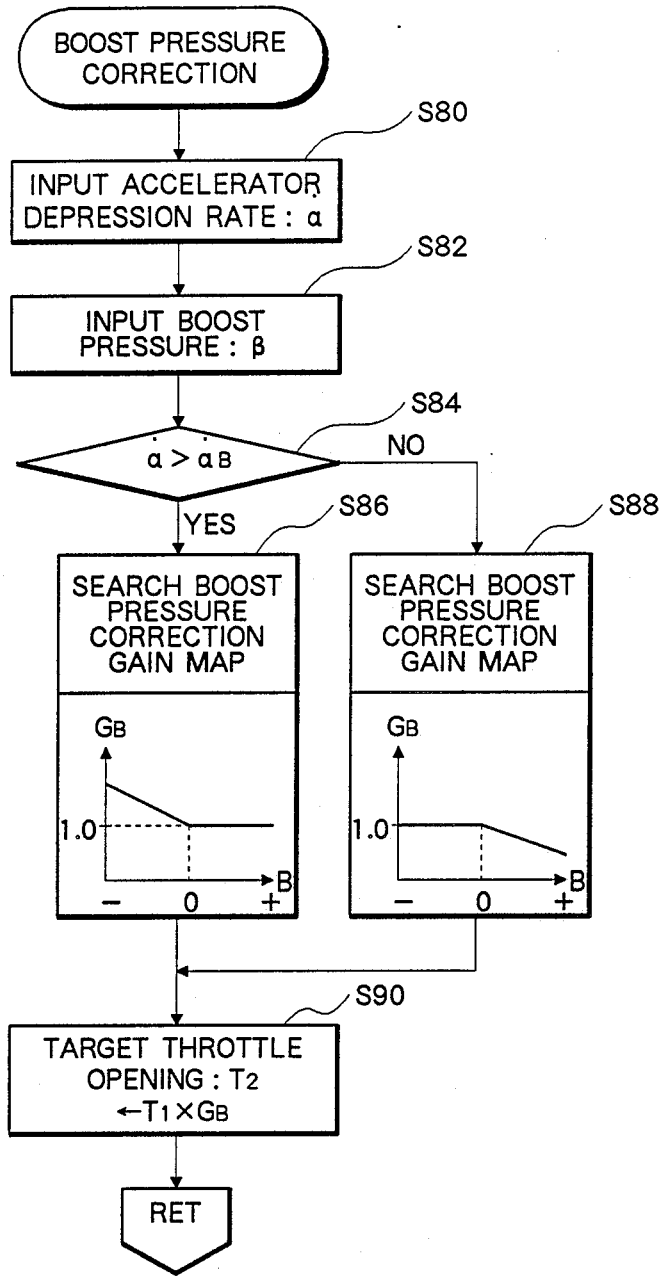
FIG. 8F is a flow chart of a boost pressure correction control program.
Figure 8G:
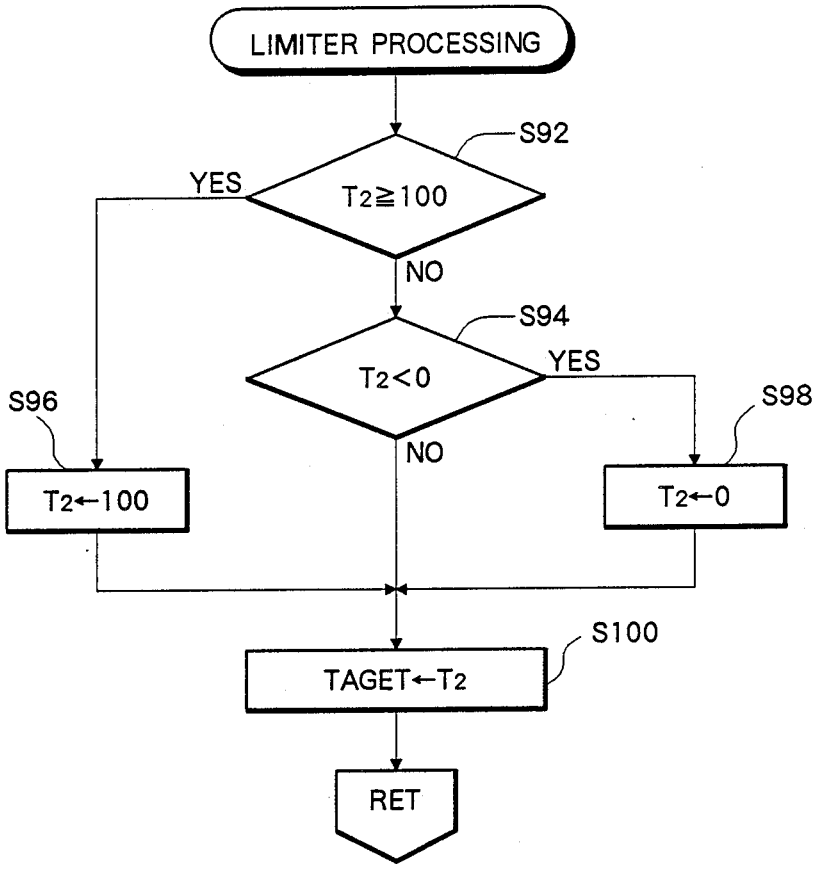
FIG. 8G is a flow chart of a limiter processing program.

Assume that an acceleration pedal opening $\alpha$ is changed by a driver, as shown in FIG. 8B. In an initial state, since the flag AF is reset, the flow advances to step S24. If it is determined in step S24 that the acceleration pedal is kept depressed, i.e., if $\dot{\alpha}>0$, the acceleration pedal depression state is determined, and in step S32, the flag AF is kept reset. More specifically, during depression of the acceleration pedal, a cycle of steps S20, S22, S24, and S32 is repeated.

When the acceleration pedal opening $\alpha$ is decreased since the acceleration pedal begins to return, $\dot{\alpha}<0$ is detected and the flow advances to step S26. It is checked in step S26 if the acceleration pedal return operation has reached a predetermined rate or more, that is, if $\dot{\alpha}<-A$ (A is a positive integer)

If NO in step S26, the detection result is processed as noise (step S28). If $\dot{\alpha}<-A$ is detected, the flow advances to step S30, and the flag AF is set to be "1" to indicate that the acceleration pedal return operation is performed.

Once the flag AF is set, the flow advances from step S22 to step S34. It is checked in step S34 if the depression rate $\dot{\alpha}$ of the acceleration pedal exceeds the constant A. Only when $\dot{\alpha}$ exceeds A, the flag AF is reset in step S36. During return of the acceleration pedal or during depression thereof with $\dot{\alpha}$ lower than A, the flag AF is kept set (step S30).

In this manner, the acceleration pedal return state is detected. Furthermore, a non-sensitive range between $-A$ and A (FIG. 8B) is provided to prevent erroneous detection of the acceleration pedal return operation. In this embodiment, during return of the acceleration pedal, since the throttle valve is to be closed along a curve different from that upon depression of the acceleration pedal (see FIG. 12B), erroneous detection of the return state of the acceleration pedal leads to an immediate change in throttle opening.

Note that A in step S26 may be different from A in step S34.

The flag AF for storing that the return state of the acceleration pedal is detected is preferably reset as quickly as possible when the transmission system AT 13 is set in a neutral state or when the clutch is disengaged. In these states, even if a deceleration state is detected based on a change in acceleration pedal opening, the throttle valve need not be controlled to decrease the engine output.

Basic Throttle Opening Map Search (FIG. 8C)

Steps S40 and S42 check if the present operation mode M fetched in step S6 (FIG. 8) corresponds to the economy, normal, or power mode. If the normal or power mode is detected in step S40 or S42, it is checked to determine if the return state of the acceleration pedal is detected (steps S44 and S46). Then, a map suitable for the detected state is determined, and a basic throttle opening $TVO_B$ corresponding to the depression amount $\alpha$ of the acceleration pedal at that time is read out from the map in step S56. Note that detailed characteristics of the maps corresponding to the states are illustrated in FIGS. 10A to 10D.

A merit of the acceleration pedal return maps will be explained below upon comparison between FIGS. 11A and 11B. In the power or normal mode, as can be seen from FIGS. 10A to 10D, the slope of the acceleration pedal opening curve is relatively steep below a given acceleration pedal opening, and becomes relatively moderate above the given acceleration pedal opening. Such an acceleration pedal opening frequently appears in a middle-velocity range or more. Meanwhile, in a middle-velocity range or more, when a driver returns the acceleration pedal, the vehicle is smoothly decelerated in response to the return operation, thus obtaining travel stability.

Figure 10A:
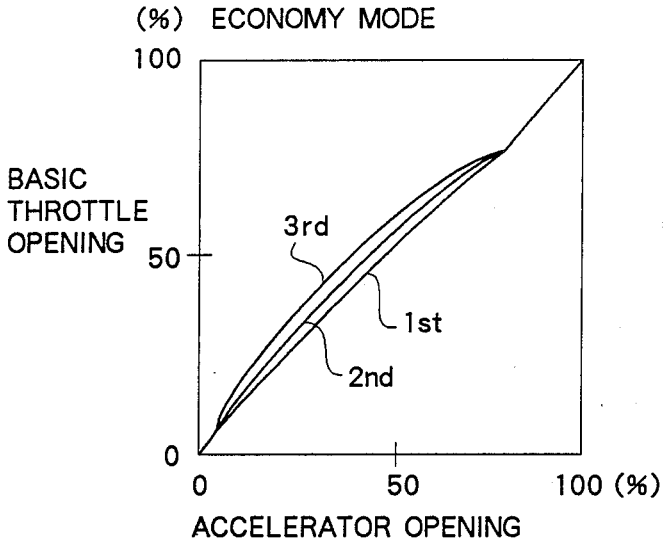
FIGS. 10A to 10D are graphs of basic throttle opening maps.
Figure 10B:
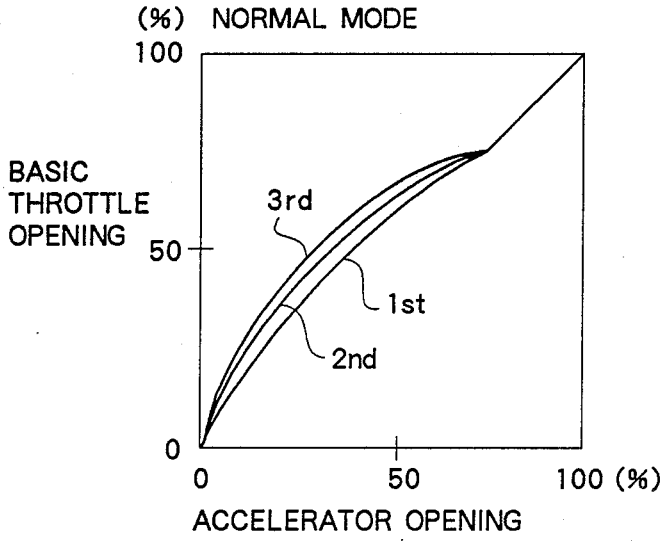
Figure 10C:
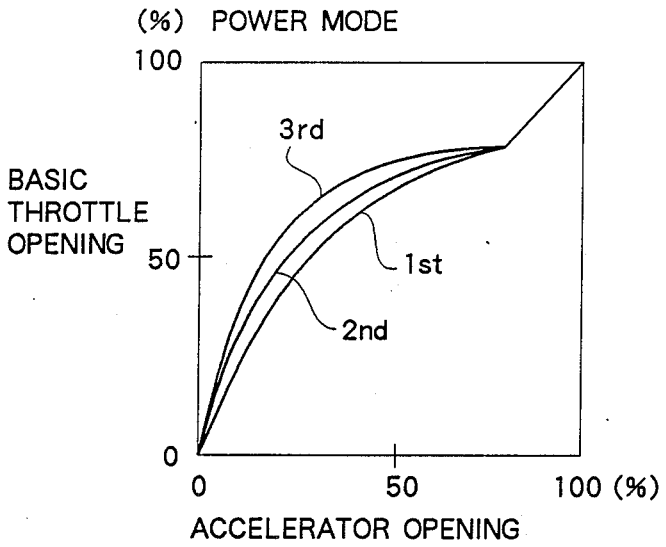
Figure 10D:
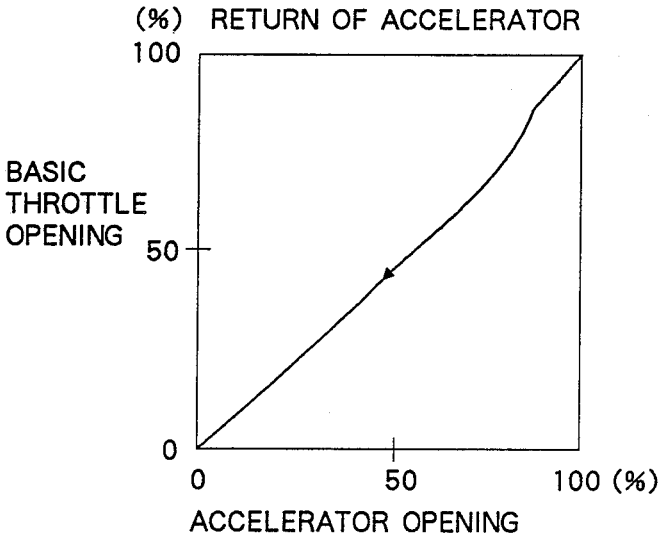
Figure 11A:
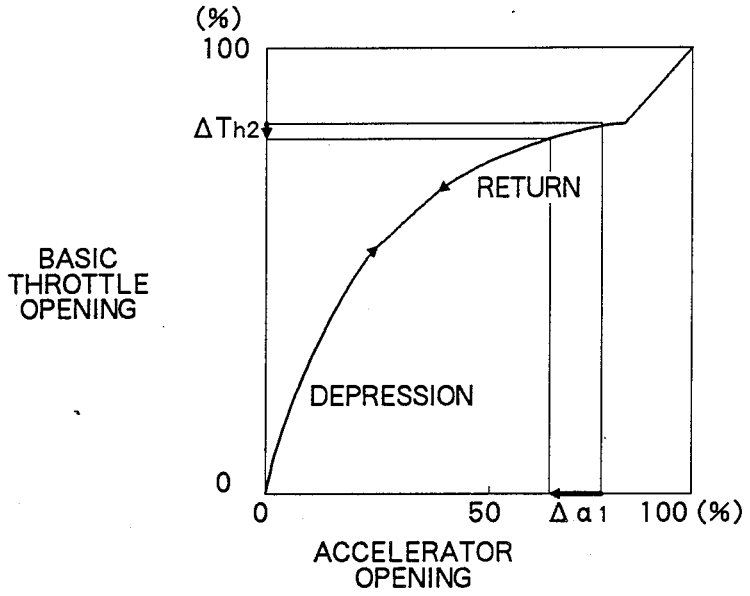
FIGS. 11A and 11B are graphs for explaining necessity of an acceleration pedal return map.
Figure 11B:
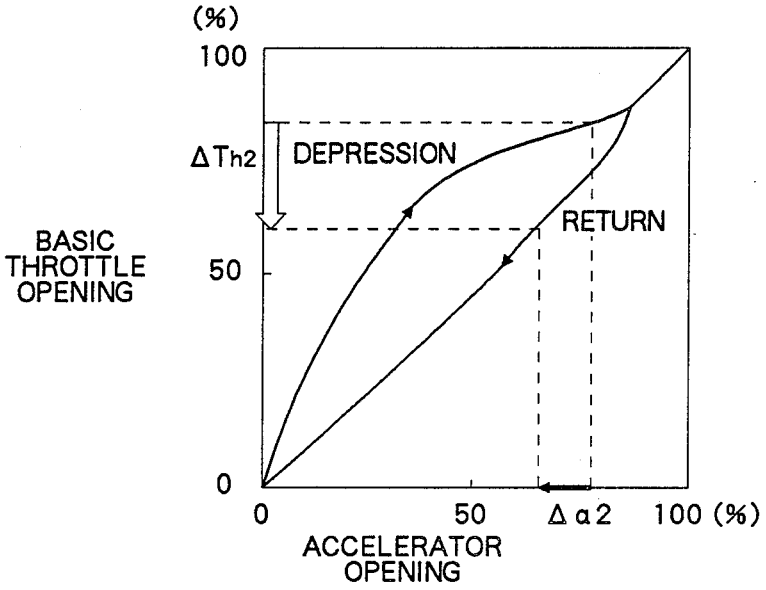

However, when the maps having the characteristics shown in FIGS. 10B and 10C are used in the acceleration pedal return state in the power and normal mode, if the acceleration pedal opening is returned by $\Delta\alpha_1$ in, e.g, the power mode in FIG. 11A, a change in throttle opening caused thereby corresponds to $\Delta T_{H1}$, and is very small. Therefore, the vehicle is decelerated less than the driver intends. In contrast to this, if the acceleration pedal opening is small (e.g., 20%), a large change in throttle opening is caused by a small change in acceleration pedal opening, and the vehicle is decelerated more than the driver intends. When relatively linear return characteristics shown in FIG. 10D are added in the power and normal modes, a decrease ($\Delta T_{H2}$) in throttle opening linearly responding to a decrease ($\Delta\alpha_2$) in acceleration pedal opening can be obtained, and the above-mentioned drawbacks can be eliminated.

The return characteristics are not added in the economy mode since map characteristics of the economy mode are relatively linear due to the engine output characteristics, and the return map is not particularly required. However, in an engine having poor output characteristics when the throttle opening is small, map characteristics having a large gain are necessary. In this case, a map for the return state of the acceleration pedal is required even in the economy mode.

Acceleration Pedal Depression Rate Correction (FIG. 8D)

In step S60, the maximum acceleration pedal depression rate $\dot{\alpha}_{max}$ calculated in the acceleration pedal depression rate calculation routine in step S206 is read out from the RAM 304. In steps S62 and S64, the present operation mode is checked. In steps S66 to S70, a correction gain map corresponding to the present operation mode is selected. In step S72, a correction gain $G_{AV}$ corresponding to the acceleration pedal depression rate $\dot{\alpha}_{max}$ is read out from the selected map, and an opening is calculated:

$$T_0 = TVO_B \times G_{AV}$$

Note that $G_{AV}=1$ in the overall range of $\dot{\alpha}_{max}$ in the economy mode. In other words, correction according to the acceleration pedal depression rate is not performed. In this embodiment, in the economy mode, $G_{AV}=1$. However, $G_{AV}>1$ may be set for an engine having poor engine output characteristics in a region wherein the throttle opening is small. On the other hand, the $G_{AV}$ characteristics in the normal and power modes tend to meet an acceleration requirement of a driver by increasing the gain as the maximum acceleration pedal depression rate $\alpha_{max}$ increases. The fact that the depression rate $\alpha_{max}$ is large regardless of the acceleration pedal opening means that the driver wants to accelerate the vehicle.

The reason why $G_{AV}$ is obtained from the maximum acceleration pedal depression rate $\dot{\alpha}_{max}$ instead of the depression rate $\dot{\alpha}$ at that time will be explained below. When a driver continues to accelerate, $\dot{\alpha}_{max}$ is continuously updated, so that $\dot{\alpha}=\dot{\alpha}_{max}$. On the other hand, when $\alpha$ is increased or decreased in the range of $\dot{\alpha} \geqq \epsilon$, the correction gain $G_{AV}$ is obtained using not decreasing $\dot{\alpha}$ but $\dot{\alpha}_{max}$ while taking into account of the will of the driver to accelerate. If $\dot{\alpha}<\epsilon$, $\dot{\alpha}_{max}$ becomes "0", and $G_{AV}$ at this time becomes "1". That is, since no correction is made, when $\dot{\alpha}_{max}$ exceeds $\dot{\alpha}A$ (steps S66 to S70), the $G_{AV}$ value is left unchanged. Therefore, there is no problem if $G_{AV}$ is determined according to the maximum acceleration pedal depression rate $\dot{\alpha}_{max}$.

If the correction gain $G_{AV}$ is obtained, a temporary target throttle opening $T_0$ is calculated in step 72 by:

$$T_0 = TVO_B \times G_{AV}$$

Vehicle Velocity Correction (FIG. 8E)

In step S74, the vehicle velocity V fetched from the vehicle velocity sensor 16 in step S200 (FIG. 9) is read out from the RAM 304, and in step S76, the correction gain $G_V$ according to the vehicle velocity is read out. In step S78, an opening $T_1$ is calculated by:

$$T_1 = T_0 \times G_V$$

In this embodiment, when the vehicle velocity V exceeds 60 km/h, this correction is started. When the velocity V exceeds 120 km/h, the correction gain is left unchanged.

Boost Pressure Correction (FIG. 8F)

In step S80, the acceleration pedal depression rate $\dot{\alpha}$ obtained in step S212 is read out, and in step S82, the boost pressure B obtained in step S202 is read out. In steps S86 and S88, a boost pressure correction gain $G_B$ is selected from the map. The characteristics of the maps are set so that a smaller value is selected when the boost pressure B is positive than in a case wherein the boost pressure B is negative.

$$G_B\,(B\text{: positive}) < G_B\,(B\text{: negative})$$

When the boost pressure B is negative, the gain is increased, so that a turbo zone (positive boost pressure state) can be reached earlier. When the boost pressure is positive, the gain is set to be low, so that difficulty in controlling the operation characteristics of the vehicle caused by an excessive increase in engine output can be compensated for, and an acceleration shock can be prevented.

Figure 12A:
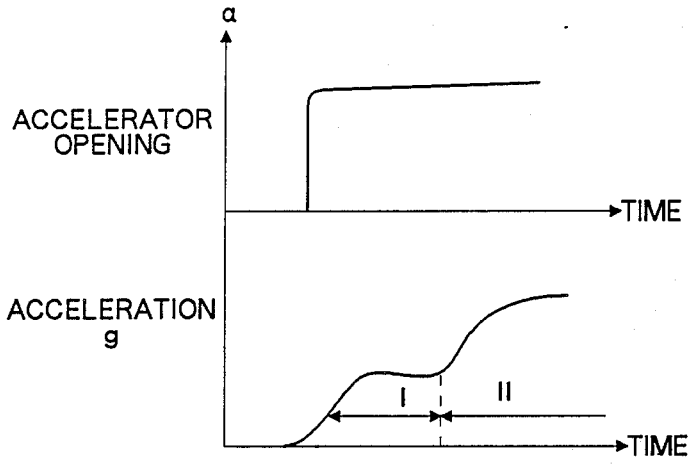
FIGS. 12A and 12B are graphs for explaining an effect of boost pressure correction according to the embodiment of the present invention in comparison with the prior art.
Figure 12B:
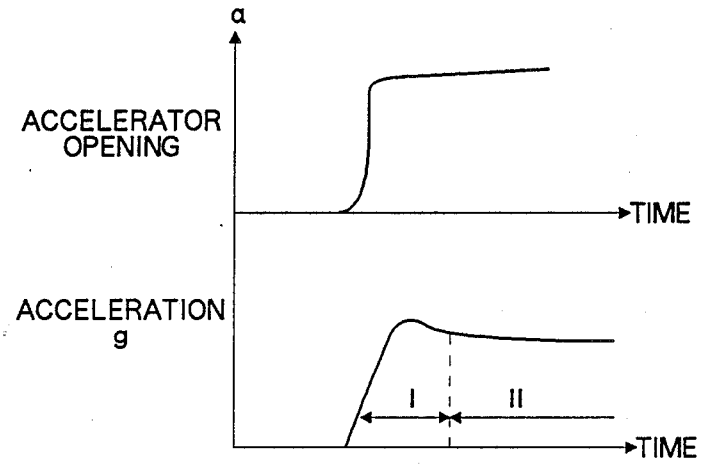

Normally, when a quick acceleration is made, the vehicle is accelerated, and the boost pressure B is changed from a negative (indicated by I in FIG. 12) to positive value (indicated by II in FIG. 12). In a conventional system, an acceleration shock is generated between I and II zones, as shown in FIG. 12A. However, according to this embodiment, an acceleration rapidly reaches a maximum value, and thereafter, is free from a variation and is smooth.

In the embodiment illustrated in FIG. 8F, a driver's will is sensed from the operation of the acceleration pedal by the driver, and fine correction control is made to allow throttle control corresponding to the operation of the acceleration pedal. In addition to correction having characteristics wherein a smaller gain is selected when the boost pressure B is positive than in a case wherein the boost pressure is negative, as described above, when $\dot{\alpha}$ exceeds a predetermined value $\dot{\alpha}_B$, that is, when the driver wants to immediately accelerate the vehicle, the gain $G_B$ is selected to be a value larger than "1" as the boost pressure B is smaller when the engine operation zone falls outside the turbo zone, so that the engine operation zone falls in the turbo zone earlier. When the operation zone falls in the turbo zone, the boost pressure correction is not performed ($G_B=1$). If the acceleration pedal depression rate $\dot{\alpha}$ satisfies the following relation:

$$\dot{\alpha} < \dot{\alpha}_B$$

the driver does not want to immediately accelerate the vehicle. Therefore, a certain acceleration property is kept in the non-turbo zone ($G_B=1$), and in the turbo zone, $G_B$ is set to be 1 or less in order to suppress unnecessary acceleration.

Limiter Processing (FIG. 8G)

In this processing, when the target throttle opening ($T_2$ calculated in step S90) which can be generated by an arithmetic operation becomes negative, it is set to be "0" (step S98), and when it exceeds 100, it is set to be "100" (step S96) in consideration of the fact that the throttle opening can be changed only within the range of 0% to 100%. In this manner, the limiter-processed throttle opening corresponds to TAGET (step S100).

In this manner, under a given operation state, the static characteristics TAGET of the throttle opening are determined in accordance with:

(I) operation mode;
(II) acceleration pedal opening$\alpha$;
(III) during return of the acceleration pedal or not;
(IV) acceleration pedal depression rate $\dot{\alpha}_{max}$;

(V) vehicle velocity V
(VI) boost pressure B and acceleration pedal depression rate $\dot{\alpha}$

Detailed Description of Throttle Control in Transient State . . . Basic Embodiment Throttle control in the transient state is made to absorb an immediate change in throttle opening by processing using the primary response filter when the acceleration pedal opening $\alpha$ is largely changed. In addition, the coefficient of the response filter (reciprocal number of the time constant) is changed in accordance with travel conditions, thus obtaining optimal travel feeling.

Figure 13:
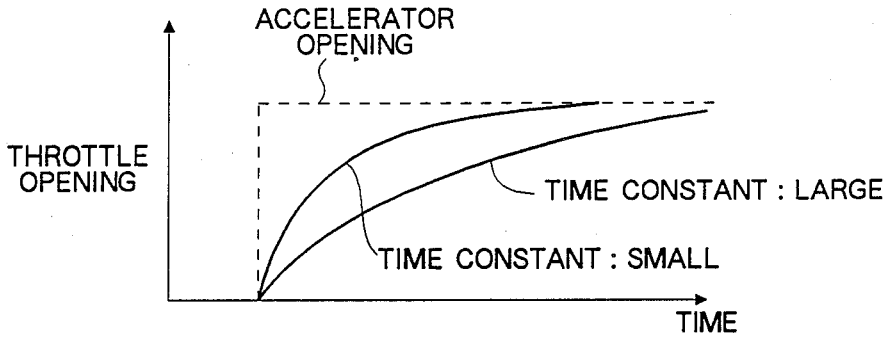
FIG. 13 is a timing chart of a primary response filter.
Figure 14:
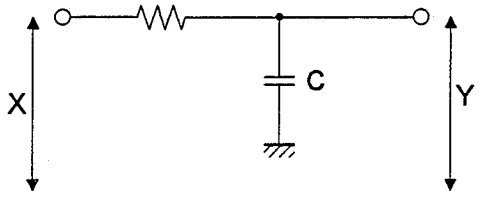
FIG. 14 is a view for explaining a method of designing the primary response filter by a digital filter.

A digital filter will be described below. As shown in FIG. 13, in order to absorb an immediate change in acceleration pedal opening indicated by a broken line, throttle opening curves indicated by solid curves must be formed. Such curves can be obtained by, e.g., exponential curves. In order to realize these curves as a filter, a primary response filter is most suitable. If the primary response filter is expressed by an electrical circuit, it corresponds to an RC integration circuit shown in FIG. 14, as is well known. In this integration circuit, input and output voltages X and Y have the relationship given by:

$$Y/X=1/(sRC+1)$$

where s is the differential operator. The above equation is transformed to a time space:

$$RC(dY/dt)+Y=X$$

This equation can be rewritten as:

$$RC\{(Yn-Yn-1)/\Delta t\}+Yn=Xn$$

Then, $$Yn=\{\Delta t/(RC+\Delta t)\}(Xn-Yn-1)+Yn-1$$

where RC is the time constant. If this value is large (its reciprocal number is small), a moderate curve is obtained, while if the time constant is small (its reciprocal number is large), a steep curve is obtained, as is well known. In the following description, Xn in the above equation is used as TAGET obtained in the limiter processing in step S100, and Yn is used as the final target throttle opening TAGETF. Thus, the coefficient $\beta$ is given by:

$$\beta=\Delta t/(RC+\Delta t)$$

Transient control will be explained with reference to FIG. 9. In step S230 and S232, the depression rate $\dot{\alpha}$ and the gear position GP are read out. In step S234, the temporary throttle opening calculated in step S100 is stored in a register $THR_1$ in the RAM. In step S236, the previously calculated final throttle opening TAGETF (30 ms before) is read out from a register $THR_2$ in the RAM.

It is checked in step S238 if the throttle valve is to be closed or opened. More specifically, if the throttle vale is to be closed, since $THR_1<THR_2$, the flow advances to step S252 to update $THR_2$. In step S254, TAGET in $THR_1$ is set to be the final throttle opening TAGETF, and is output to the throttle actuator 9 through the throttle controller 18 in step S256. That is, filtering processing for response delay need not be performed when the throttle valve is to be closed.

If the throttle valve is to be opened, that is, $$\text{if } THR_1>THR_2$$

the flow advances to step S240. In step S240, the coefficient $\beta$ is updated in accordance with the value $\dot{\alpha}$. More specifically, if $\dot{\alpha}<\dot{\alpha}_0$, since the depression rate $\dot{\alpha}$ of the acceleration pedal is small, an acceleration shock is considered to be small. Therefore, the coefficient $\beta$ is set to be a larger value (e.g., $\beta=0.08$) in order to increase an actual throttle opening and to keep a certain acceleration response (step S242). In contrast to this, if $\dot{\alpha}\geqq\dot{\alpha}_0$, the coefficient $\beta$ is set to be a smaller value (e.g., $\beta=0.04$) in order to suppress an acceleration shock and to reduce a change in throttle opening with respect to a change in operation of the acceleration pedal (step S244).

In step S246, filtering processing is performed. This processing is made to increase the present $THR_2$ from the immediately preceding $THR_2$ (30 ms before) by:

$$\beta x\ (THR_1-THR_2)$$

For example, if $\beta=0.04$, $$0.04\ x\ (THR_1-THR_2)$$

The value $\dot{\alpha}_0$ is properly set to be:

$$9.4\%/7.5\ \text{ms}$$

It is checked in step S248 if the gear position corresponds to the 1st speed (GP=1) or the acceleration pedal is in the return state (AF=1). If GP=1 or AF=1, the value calculated in step S246 is not employed as a value to be stored in $THR_2$, and TAGET is employed in step S250. This is because if GP=1 or AF=1, a response speed with respect to the operation of the acceleration pedal is given prime importance. That is, the 1st speed is normally used for starting the vehicle. In this case, the engine speed is low. The low engine speed range corresponds to a low torque range (this tendency is conspicuous in a turbo-charged engine). In an AT vehicle, in this case, the response speed with respect to the operation of the acceleration pedal appears as a poor response of vehicle start rather than an acceleration shock. When the filtering processing is performed in the return state of the acceleration pedal, deceleration feeling matching with the acceleration pedal operation feeling of the driver cannot be obtained.

If neither GP=1 nor AF=1, the delayed $THR_2$ is output as the throttle opening in steps S252 and S256.

Detailed Description of Throttle Control in Transient State . . . Modification In the above-mentioned basic embodiment of the throttle control in the transient state, the slope of a change in throttle opening with respect to a change in acceleration pedal opening $\alpha$ is varied in accordance with the depression rate $\dot{\alpha}$ of the acceleration pedal. In this modification, the slope of the change in throttle opening is changed in accordance with the gear position GP and the operation mode M as well as the above factor. This control is shown in FIG. 9C in detail.

Figure 9D:
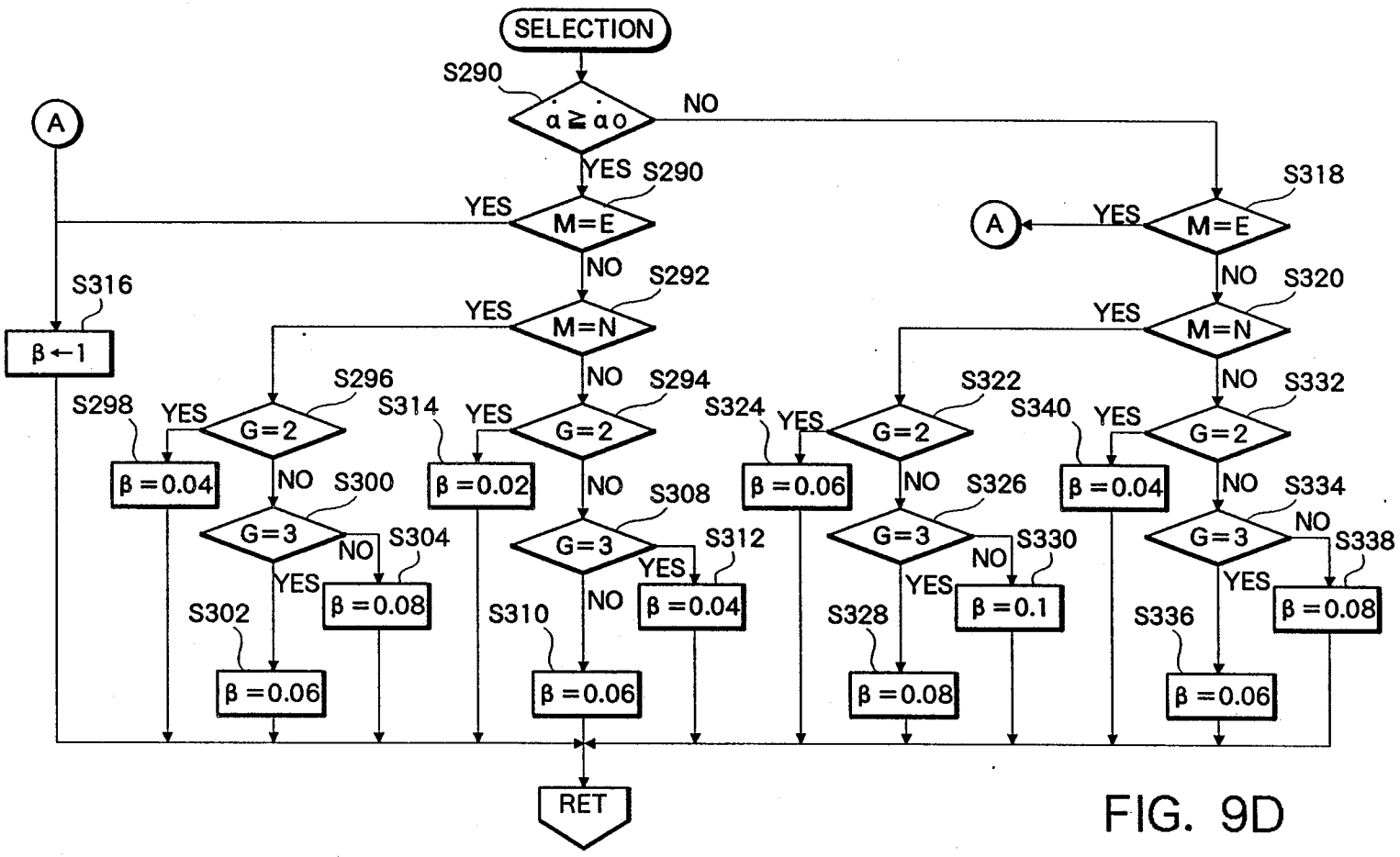

In the basic embodiment shown in FIG. 9B, two kinds of $\beta$ are prepared in accordance with the value of the acceleration pedal depression rate $\dot{\alpha}$. In the modification shown in FIG. 9C, since the value $\beta$ is changed in accordance with $\dot{\alpha}$, the gear position GP, and the operation mode M, a method of selecting $\beta$ need only be explained. The selection step corresponds to step S278, and a detailed program therefor is shown in FIG. 9D. FIGS. 9E(a) and 9E(b) show the relationship among the coefficient $\beta$ selected under the control shown in FIG. 9D, the gear position GP, and the operation mode M.

According to the relationship illustrated in FIG. 9E:

(1) $\beta$ is relatively small as the acceleration pedal depression rate $\dot{\alpha}$ increases for the same reason as in control according to the basic embodiment shown in FIG. 9C;

(2) $\beta$ is decreased to increase a delay time as a lower gear position is selected except when the 1st-speed gear is selected or the acceleration pedal is in the return state. Since the torque is increased as a lower gear position is selected, an acceleration shock due to a change in acceleration pedal depression rate is increased; and (3) In accordance with a selected mode, the value of $\beta$ changes as:

$$\beta(\text{power}) < \beta(\text{normal}) < \beta(\text{economy})$$

A delay time is increased more in the normal mode than in the economy mode, and is increased more in the power mode than in the normal mode.

In this manner, a primary response delay time is set in accordance with the acceleration pedal depression rate $\dot{\alpha}$, the gear position GP, and the operation mode M, so that an immediate change in acceleration pedal opening does not cause an immediate change in throttle opening, and is smoothed, thus reducing an acceleration shock.

Other Modifications

In the above embodiment, the EAT vehicle has been exemplified. The present invention can be applied to a so-called MT vehicle. This is because, the MT vehicle also has a problem of an acceleration shock when an acceleration pedal is depressed deeper as a lower gear position is selected. A transmission mode is updated by changing a transmission shift point in the above embodiment. However, the present invention can be applied to a vehicle which changes a transmission mode by changing a final transmission ratio.

The present invention is not limited to a gasoline vehicle but may be applied to a diesel vehicle. Furthermore, the supercharger is not limited to a turbo charger utilizing an exhaust gas but may be applied to a mechanical supercharger or an inertial supercharger.

As many apparently widely different embodiments of the present invention can be made without departing from the spirit and scope thereof, it is to be understood that the invention is not limited to the specific embodiments thereof except as defined in the appended claims.

What is claimed is:

1. An engine control apparatus comprising:

operation amount detection means for detecting an operation amount of an accelerator;

engine output adjusting means for adjusting an engine output;

arithmetic means for receiving the output from said operation amount detection means and calculating a control amount corresponding to the output operation amount of the accelerator in accordance with a predetermined characteristic, said control amount being one for controlling said engine output adjusting means;

drive means for receiving the output from said arithmetic means and driving said engine output adjusting means in accordance with said control amount calculated by said arithmetic means;

return detection means for detecting a return state of said accelerator; and control means for, when said return detection means detects the return state of said accelerator, controlling said arithmetic means to output said control amount in accordance with a characteristic with which the engine output is decreased below that according to said predetermined characteristic.

2. The apparatus according to claim 1, wherein said adjusting means comprises a throttle valve arranged along an intake path of an engine, and said drive means comprises a motor for driving said throttle valve.

3. The apparatus according to claim 1, wherein said control means is connected to said operation amount detection means, and the engine output decreasing characteristic of said control means decreases the engine output below that obtained with said predetermined characteristic in said arithmetic means with a control amount corresponding to an identical operation amount of said accelerator.

4. The apparatus according to claim 1, wherein said control means is connected to said operation amount detection means, and the engine output decreasing characteristic of said control means decreases the engine output below that obtained with said predetermined characteristic in said arithmetic means with a control amount corresponding to an identical change in operation amount of said accelerator.

5. The apparatus according to claim 1, wherein said return detection means is connected to said operation amount detection means, and detects the return state of said accelerator when a change in operation amount in a return direction of said accelerator exceeds a predetermined value.

6. An engine control apparatus comprising:

operation amount detection means for detecting an operation amount of an accelerator;

engine output adjusting means for adjusting an engine output;

first arithmetic means for receiving the output from said operation amount detection means and calculating a first control amount corresponding to the output operation amount of said accelerator in accordance with a first characteristic, said first control amount being one for controlling said engine output adjusting means;

second arithmetic means for receiving the output from said operation amount detection means and calculating a second control amount corresponding to the output operation amount of said accelerator in accordance with a second characteristic, said second control amount being one for controlling said engine output adjusting means, and said second characteristic causing an output to decrease below that obtained with said first characteristic;

drive means for receiving the outputs from said first and second arithmetic means and driving said adjusting means;

return detection means for detecting a return state of said accelerator; and control means for, when said return detection means does not detect the return state of said accelerator, controlling said drive means based on said first control amount and for, when said return detection means detects the return state of said accelerator, controlling said drive means based on said second control amount.

7. The apparatus according to claim 6, wherein said adjusting means comprises a throttle valve arranged along an intake path of an engine.

8. The apparatus according to claim 6, wherein said first arithmetic means stores said first control amount according to the first characteristic in the form of a map, and said second arithmetic means stores said second control amount according to the second characteristic in the form of a map.

9. The apparatus according to claim 6, wherein said first arithmetic means comprises:

means for detecting an acceleration based on a change in operation amount of said accelerator; and means for receiving the output from said means and correcting said first characteristic to increase the engine output.

10. The apparatus according to claim 6, wherein said first characteristic of the first arithmetic means has a relatively steep first slope with respect to an increase in operation amount while the operation amount of said accelerator is small, and has a relatively moderate second slope with respect to an increase in operation amount when the operation amount of said accelerator exceeds a predetermined value, and said second characteristic of said second arithmetic means has a slope for decreasing the engine output below that obtained with the second slope with respect to a decrease in operation amount of said accelerator when the operation amount of said accelerator exceeds the predetermined value.

11. The apparatus according to claim 6, wherein said control apparatus further includes means for detecting a transmission mode in external transmission means, said arithmetic means and said control means are connected to said transmission mode detecting means, said first arithmetic means has map means for storing said first control amount according to said first characteristic, said map means having a plurality of maps representing different characteristics in accordance with the operation modes, and said control means includes means for, when said transmission mode detecting means detects a transmission mode having a highest efficiency, for stopping an operation of controlling said drive means based on said second control amount even if said return detection means detects the return state of said accelerator.

12. The apparatus according to claim 6, wherein said control means includes:

acceleration detection means, connected to said operation amount detection means, for detecting that an increase in operation amount of said accelerator exceeds the predetermined value; and resume means for, upon reception of the output from said acceleration detection means while said control means controls said drive means based on said second control amount, resuming control of said drive means based on said first control amount.

13. The apparatus according to claim 1, wherein said control apparatus further comprises means for detecting whether or not the engine output is transmitted to an external drive system, and said control means includes means, connected to said detecting means, for, when said detecting means detects that the engine output is not transmitted to said external drive system, stopping an operation of controlling said drive means based on said second control amount even if said return detection means detects the return state of said accelerator.

14. The apparatus according to claim 6, wherein said control apparatus further comprises means for detecting whether or not the engine output is transmitted to an external drive system, and said control means includes means, connected to said detecting means, for, when said detecting means detects that the engine output is not transmitted to said external drive system, stopping an operation of controlling said drive means based on said second control amount even if said return detection means detects the return state of said accelerator.

* * * * *